US009032746B2

(12) United States Patent
Ito et al.

(10) Patent No.: US 9,032,746 B2
(45) Date of Patent: May 19, 2015

(54) ICE MAKING DEVICE AND CONTROL METHOD USING ELECTROSTATIC CAPACITANCE

(75) Inventors: Akihiro Ito, Nagano (JP); Masako Hashimoto, Nagano (JP)

(73) Assignee: NIDEC SANKYO CORPORATION (JP)

( * ) Notice: Subject to any disclaimer, the term of this patent is extended or adjusted under 35 U.S.C. 154(b) by 505 days.

(21) Appl. No.: 13/433,834

(22) Filed: Mar. 29, 2012

(65) Prior Publication Data

US 2012/0247130 A1 Oct. 4, 2012

(30) Foreign Application Priority Data

Mar. 29, 2011 (JP) ..... 2011-072249
Mar. 29, 2011 (JP) ..... 2011-072281
Mar. 29, 2011 (JP) ..... 2011-072330

(51) Int. Cl.
*F25C 1/00* (2006.01)
*F25C 1/04* (2006.01)

(52) U.S. Cl.
CPC ..... *F25C 1/04* (2013.01); *F25C 2305/022* (2013.01); *F25C 2700/04* (2013.01)

(58) Field of Classification Search
USPC ..... 62/72, 135, 66, 459, 136
See application file for complete search history.

(56) References Cited

U.S. PATENT DOCUMENTS

| | | | | |
|---|---|---|---|---|
| 5,460,007 | A * | 10/1995 | Reed et al. | 62/137 |
| 5,829,266 | A * | 11/1998 | Lyu | 62/353 |
| 6,311,503 | B1 * | 11/2001 | Shapiro et al. | 62/138 |
| 6,453,866 | B1 * | 9/2002 | Altmann et al. | 123/184.21 |
| 6,526,763 | B2 * | 3/2003 | Tchougounov et al. | 62/71 |
| 7,010,934 | B2 * | 3/2006 | Choi et al. | 62/353 |
| 7,216,491 | B2 * | 5/2007 | Cole et al. | 62/74 |
| 2006/0086107 | A1 * | 4/2006 | Voglewede et al. | 62/135 |
| 2006/0201170 | A1 | 9/2006 | Cole | |
| 2007/0056947 | A1 * | 3/2007 | Damian | 219/203 |
| 2009/0211267 | A1 * | 8/2009 | Kim et al. | 62/66 |

FOREIGN PATENT DOCUMENTS

| | | | |
|---|---|---|---|
| JP | 2005-315472 | A | 11/2005 |
| JP | 2011-12916 | A | 1/2011 |

* cited by examiner

*Primary Examiner* — Cheryl J Tyler
*Assistant Examiner* — David Teitelbaum
(74) *Attorney, Agent, or Firm* — Cantor Colburn LLP

(57) ABSTRACT

An ice making device may include an ice tray, a water-supply part for supplying water to the ice tray, an electrostatic capacity sensor having two or more electrodes attached to the ice tray, a water quantity detecting section for detecting a water quantity in the ice tray on a basis of variation of an electrostatic capacity between the electrodes of the electrostatic capacity sensor, and an ice frozen detecting section for detecting water supplied to the ice tray having been frozen on the basis of the variation of the electrostatic capacity between the electrodes of the electrostatic capacity sensor. A control unit for the ice making device controls the water-supply part, an ice tray drive part and an ice detecting part on the basis of variation of the electrostatic capacity between the electrodes of the electrostatic capacity sensor.

17 Claims, 17 Drawing Sheets

ICE MAKING DEVICE AND CONTROL METHOD USING ELECTROSTATIC CAPACITANCE

CROSS REFERENCE TO RELATED APPLICATION

The present invention claims priority under 35 U.S.C. §119 to Japanese Application No. 2011-072249 filed Mar. 29, 2011, No. 2011-072281 filed Mar. 29, 2011, and No. 2011-072330 filed Mar. 29, 2011, the entire contents of which are incorporated herein by reference.

FIELD OF THE INVENTION

At least an embodiment of the present invention may relate to an ice making device which is provided with a structure for detecting a state within an ice tray by an electrostatic capacity sensor and may relate to a control method for the ice making device.

BACKGROUND

An ice making device has been known in which a series of operations from supplying water to an ice tray to storing ice pieces into a container are automatically performed. In the ice making device, a state within the ice tray (a state that water is existed, a state that ice pieces are existed, and a state that the ice tray is empty) is detected by various methods and an actuator and the like are controlled so as to perform a series of operations depending on a state within the ice tray. For example, in Japanese Patent Laid-Open No. 2005-315472 and Japanese Patent Laid-Open No. 2011-012916, ice making devices are disclosed in which a state within an ice tray is detected by reflection of light (optical sensor) or temperature (temperature sensor). Further, in US 2006/0201170, an ice making device is disclosed in which a water-supply quantity to an ice tray is accurately controlled by an electrostatic capacity sensor.

However, a structure which detects a state within an ice tray through reflection of light or by a temperature sensor is easily affected by states of water and ice existed within the ice tray and variation of ambient temperature and thus the state within the ice tray may not be detected accurately. Especially, in the structure which detects a state within an ice tray through reflection of light, the reflectivity of light is varied by the surface of water and ice in a wavy state and thus the state cannot be detected accurately. In an ice making compartment which is provided in a refrigerator, an ice tray may be shaken by vibration accompanied with opening and closing of its door (including another door in addition to the door of the ice making compartment) and thus the surface of water or ice within the ice tray may easily become in a wavy state.

Further, in order to accurately control a water-supply quantity to an ice tray and to accurately discriminate existence of water and ice within the ice tray, an ice making device which is currently used is provided with a plurality of sensors or a complicated control program and thus its cost is increased.

Further, in the structure of the ice making device described in US 2006/0201170, in which a water-supply quantity to an ice tray is controlled by an electrostatic capacity sensor, the electrode structuring the electrostatic capacity sensor is exposed on an inner side of the ice tray and thus the electrode may be corroded by water within the ice tray and, as a result, the water-supply quantity cannot be controlled accurately.

Further, the water may be polluted by corrosion of the electrode to occur a hygienic problem.

SUMMARY

In view of the problems described above, at least an embodiment of the present invention may advantageously provide an ice making device which is capable of accurately controlling a water-supply quantity to the ice tray and is capable of accurately detecting whether ice pieces have been completed in the ice tray or not.

Further, in view of the problems described above, at least an embodiment of the present invention may advantageously provide an ice making device having a simple structure in which a series of operations from a process of water supply to the ice tray to a process for storing completed ice pieces in a container can be performed automatically and accurately, and may advantageously provide its control method.

According to at least an embodiment of the present invention, there may be provided an ice making device including an ice tray, a water-supply part for supplying water to the ice tray, an electrostatic capacity sensor having two or more electrodes which are attached to the ice tray and are respectively insulated, a water quantity detecting section for detecting a water quantity in the ice tray which is supplied through the water-supply part on the basis of variation of an electrostatic capacity between the electrodes of the electrostatic capacity sensor, and an ice frozen detecting section for detecting the water supplied to the ice tray through the water-supply part having been frozen on the basis of the variation of the electrostatic capacity between the electrodes of the electrostatic capacity sensor.

According to the embodiment of the present invention, a water quantity in the ice tray is capable of being detected by variation of an electrostatic capacity between the electrodes of the electrostatic capacity sensor, and a state that the water supplied to the ice tray has been frozen is capable of being detected by the variation of the electrostatic capacity between the electrodes of the electrostatic capacity sensor. Specifically, it is preferable that the water quantity detecting section is provided with a first threshold value which is set on the basis of an electrostatic capacity value in a state that a predetermined quantity of water is existed in the ice tray, and the ice frozen detecting section is provided with a second threshold value which is set on the basis of the electrostatic capacity value in a state that all the predetermined quantity of the water within the ice tray has been frozen.

Further, according to at least another embodiment of the present invention, there may be provided an ice making device including an ice tray, a water-supply part for supplying water to the ice tray, an electrostatic capacity sensor having two or more electrodes which are attached to the ice tray and are respectively insulated, a water quantity detecting section for detecting a water quantity in the ice tray which is supplied through the water-supply part on the basis of variation of an electrostatic capacity between the electrodes of the electrostatic capacity sensor, an ice frozen detecting section for detecting the water supplied to the ice tray through the water-supply part having been frozen on the basis of the variation of the electrostatic capacity between the electrodes of the electrostatic capacity sensor, and an ice dropped detecting section for detecting that ice pieces have been dropped from the ice tray on the basis of the variation of the electrostatic capacity between the electrodes of the electrostatic capacity sensor.

According to the embodiment of the present invention, a water quantity supplied to the ice tray, a state that the water supplied to the ice tray has been frozen, and a state that ice pieces have been separated (dropped), i.e., a state that the ice tray is empty are capable of being detected by the variation of the electrostatic capacity between the electrodes of the electrostatic capacity sensor. Specifically, it is preferable that the water quantity detecting section is provided with a first threshold value which is set on the basis of an electrostatic capacity value in a state that a predetermined quantity of water is existed in the ice tray, the ice frozen detecting section is provided with a second threshold value which is set on the basis of the electrostatic capacity value in a state that all the predetermined quantity of the water within the ice tray has been frozen, and the ice dropped detecting section is provided with a third threshold value which is set on the basis of the electrostatic capacity value in a state that the ice tray is empty.

Further, according to at least an embodiment of the present invention, there may be provided an ice making device and a control method for an ice making device including an ice tray, a water-supply part for supplying water to the ice tray, an ice tray drive part for performing an ice separating operation on the ice tray, an ice storage container in which ice pieces dropped from the ice tray are stored, an ice detecting part for detecting whether an ice quantity in the ice storage container is less than a certain amount or not, an electrostatic capacity sensor having two or more electrodes which are attached to the ice tray and are respectively insulated, and a control unit for controlling the water-supply part, the ice tray drive part and the ice detecting part on the basis of variation of an electrostatic capacity between the electrodes of the electrostatic capacity sensor so as to sequentially repeat operations of a first process through a fourth process described below;

(1) the first process:
  the ice tray is confirmed to be located at a home position and water supply to the ice tray is started through the water-supply part;
(2) the second process:
  the water supply through the water-supply part is continued until a measured electrostatic capacity value becomes not less than a first threshold value and, in response to that the measured electrostatic capacity value becomes not less than the first threshold value, the water supply through the water-supply part is stopped;
(3) the third process:
  after the water supply is stopped, in response to that the measured electrostatic capacity value becomes below a second threshold value and it is detected by the ice detecting part that a quantity of ice pieces in the ice storage container is less than a certain amount, an ice separating operation is performed by the ice tray drive part;
(4) the fourth process:
  after the ice separating operation is finished, the ice tray is returned to the home position by the ice tray drive part and an operation of the first process is started;

wherein the first threshold value is a value which is predetermined on the basis of an electrostatic capacity value in a state that a predetermined quantity of water is existed in the ice tray, and the second threshold value is a value which is predetermined on the basis of the electrostatic capacity value in a state that all the predetermined quantity of the water in the ice tray has been frozen.

According to the embodiment of the present invention, a series of operations from a process of water supply to the ice tray (control of a water-supply quantity) to a process storing completed ice pieces in an ice storage container is capable of being performed accurately on the basis of the electrostatic capacity measured by a single electrostatic capacity sensor.

In this case, in an initial state, the control unit may control so that, when the measured electrostatic capacity value is not less than the second threshold value, an operation of the third process is performed and, when the measured electrostatic capacity value is below the second threshold value and it is detected by the ice detecting part that the quantity of the ice pieces in the ice storage container is less than the certain amount, the ice separating operation is performed by the ice tray drive part and then an operation of the fourth process is performed.

In a case that a state within the ice tray is to be detected on the basis of an electrostatic capacity, it may become a problem that a difference between the dielectric constant of ice (about 4.2) and the dielectric constant of air (about 1.0) is a little. In other words, when an inexpensive electrostatic capacity sensor is used in order to reduce a cost of the device, the difference between a state that ice pieces are existed in the ice tray and a state that the ice tray is empty may not be correctly distinguished. However, as described above, even when the state that ice pieces are existed in the ice tray and the state that the ice tray is empty are not distinguished, in a case that the measured electrostatic capacity value is below the second threshold value and it is detected by the ice detecting part that the quantity of the ice pieces in the ice storage container is less than the certain amount, firstly, the ice separating operation is performed. In this case, the ice tray is made in an empty state after the ice separating operation and, after that, the normal operation may be performed from the fourth process.

Further, according to at least another embodiment of the present invention, there may be provided an ice making device and a control method for an ice making device including an ice tray, a water-supply part for supplying water to the ice tray, an ice tray drive part for performing an ice separating operation on the ice tray, an ice storage container in which ice pieces dropped from the ice tray are stored, an ice detecting part for detecting whether an ice quantity in the ice storage container is less than a certain amount or not, an electrostatic capacity sensor having two or more electrodes which are attached to the ice tray and are respectively insulated, and a control unit for controlling the water-supply part, the ice tray drive part and the ice detecting part on the basis of variation of an electrostatic capacity between the electrodes of the electrostatic capacity sensor so as to sequentially repeat operations of a first process through a fourth process described below;

(1) the first process:
  the ice tray is confirmed to be located at a home position and water supply to the ice tray is started through the water-supply part;
(2) the second process:
  the water supply through the water-supply part is continued until a measured electrostatic capacity value becomes not less than a first threshold value and, in response to that the measured electrostatic capacity value becomes not less than the first threshold value, the water supply through the water-supply part is stopped;
(3) the third process:
  after the water supply is stopped, in response to that the measured electrostatic capacity value becomes below a second threshold value and it is detected by the ice detecting part that a quantity of ice pieces in the ice storage container is less than a certain amount, an ice separating operation is performed by the ice tray drive part;

(4) the fourth process:

after the ice separating operation is finished, the ice tray is returned to the home position by the ice tray drive part and, in response to that the measured electrostatic capacity value becomes below a third threshold value, an operation of the first process is started, on the other hand, in a case that the measured electrostatic capacity value is not less than the third threshold value, the ice separating operation is performed by the ice tray drive part again, and the ice tray is returned to the home position by the ice tray drive part and it is detected whether the measured electrostatic capacity value is below the third threshold value or not;

wherein the first threshold value is a value which is predetermined on the basis of an electrostatic capacity value in a state that a predetermined quantity of water is existed in the ice tray, the second threshold value is a value which is predetermined on the basis of the electrostatic capacity value in a state that all the predetermined quantity of the water in the ice tray has been frozen, and the third threshold value is a value which is predetermined on the basis of the electrostatic capacity value in a state that the ice tray is empty.

According to the embodiment of the present invention, a series of operations from a process of water supply to the ice tray (control of a water-supply quantity) to a process storing completed ice pieces in an ice storage container is capable of being performed accurately on the basis of the electrostatic capacity measured by a single electrostatic capacity sensor. Further, after the ice separating operation, it is detected that ice pieces are not existed in the ice tray (ice pieces have been dropped) and thus, a state is prevented that water supply to the ice tray is started in the state that ice pieces are not separated completely and water is overflowed from the ice tray.

In this case, it is preferable that, in an initial state, in a case that the measured electrostatic capacity value is not less than the second threshold value, an operation of the third process is performed and, in a case that the measured electrostatic capacity value is below the second threshold value and not less than the third threshold value, and it is detected by the ice detecting part that a quantity of ice pieces in the ice storage container is less than a certain amount, an ice separating operation is performed by the ice tray drive part and then an operation of the fourth process is performed and, in a case that the measured electrostatic capacity value is below the third threshold value, an operation of the first process is performed.

When an electrostatic capacity sensor with a high degree of detection accuracy is used, a state that ice pieces are existed in the ice tray and a state that the ice tray is empty are distinguished from each other on the basis of a difference between the dielectric constant of ice (about 4.2) and the dielectric constant of air (about 1.0). In this case, when an electrostatic capacity value measured in the initial state is below the third threshold value, water-supply operation (operation of first process) can be performed immediately. In other words, a turning operation of the ice tray in an empty state (ice separating operation of the ice tray in an empty state) is not required to be performed.

Further, it is preferable that, in the third process, energization to the detecting section for detecting the electrostatic capacity between the electrodes of the electrostatic capacity sensor is stopped until a predetermined time period is passed after the water supply is stopped.

After a predetermined quantity of water is supplied to the ice tray, a time period not less than a certain time period is required for the water to be frozen. In other words, ice pieces are not frozen during the certain time period from the stoppage of water-supply and thus the electrostatic capacity is not required to be detected. Therefore, when the energization to the detecting section is stopped during a certain time period which is at least shorter than the required time period, electric power required for detection of the electrostatic capacity is reduced by that amount.

Further, it is preferable that, in the third process, energization to the detecting section for detecting the electrostatic capacity between the electrodes of the electrostatic capacity sensor is stopped until the ice separating operation is finished after the measured electrostatic capacity value becomes below the second threshold value.

After it is detected that the measured electrostatic capacity value is below the second threshold value and, until it is detected by the ice detecting part that ice pieces in the ice storage container is less than a certain amount, the ice separating operation is not started and the state that ice pieces are existed in the ice tray is maintained as it is. In some cases, ice pieces are not used at all and the state that the quantity of ice pieces in the ice storage container is not less than the certain amount may continue a long time and thus, during this time period, it is preferable that energization to the detecting section is stopped. Further, it is not required to detect the state within the ice tray during the ice separating operation and thus, although it may be a short time period, it is preferable that energization to the detecting section is stopped during this time period. When the energization to the sensing section is stopped for a certain time period, electric power required for detection of the electrostatic capacity is reduced.

Further, it may be preferable that, in the third process, the energization to the detecting section for detecting the electrostatic capacity between the electrodes of the electrostatic capacity sensor is intermittently performed when it is detected whether the measured electrostatic capacity value becomes below the second threshold value or not.

Delay of timing for detecting whether the measured electrostatic capacity value becomes below the second threshold value or not, in other words, delay of timing for detecting whether the water in the ice tray has been frozen or not does not occur any problem (exact moment when water becomes ice pieces completely is not necessary). Therefore, in this case, when the detecting section is operated intermittently, electric power required for detection of the electrostatic capacity is reduced.

Further, according to at least another embodiment of the present invention, there may be provided an ice making device including an ice tray which is formed of an insulator, a water-supply part for supplying water to the ice tray, an electrostatic capacity sensor having two or more electrodes which are attached to the ice tray and are respectively insulated, and a water quantity detecting section for detecting a water quantity in the ice tray which is supplied through the water-supply part on the basis of variation of an electrostatic capacity between the electrodes of the electrostatic capacity sensor. The electrodes of the electrostatic capacity sensor are attached to an outer face of the ice tray.

In the ice making device in accordance with at least an embodiment of the present invention, a water quantity is detected on the basis of variation of the electrostatic capacity between the electrodes of the electrostatic capacity sensor. The electrode of the electrostatic capacity sensor is attached to an outer face of the ice tray which is an insulator and thus the water supplied to the ice tray and the electrode are isolated from each other through the ice tray. Therefore, corrosion (deterioration) of the electrode due to the water supplied to the ice tray is prevented and thus a water-supply quantity to the ice tray is controlled accurately. Further, pollution of the water through corrosion of the electrode is also prevented. In addition, it is prevented that the water is electrolyzed by the electrode and hydrogen and oxygen are filled in the freezer.

Further, it is preferable that the electrodes of the electrostatic capacity sensor are attached to two faces oppositely disposed to each other along a longitudinal direction of the ice tray.

According to this structure, an area of the electrode of the electrostatic capacity sensor is increased and a distance between the electrodes can be relatively decreased (distance between the electrodes is substantially coincided with the length in the short side direction of the ice tray) and thus the detection accuracy of the electrostatic capacity sensor is further improved. Therefore, the water-supply quantity to the ice tray is controlled further accurately.

Further, in this case, it is preferable that a connection part for connecting the ice tray to another member is formed on a face in the short side direction of the ice tray.

Normally, an outer face of the ice tray is required to provide a connection part for connecting the ice tray with another member. When the connection part is formed on the face in the short side direction of the ice tray, the electrode can be attached to a wide face in the longitudinal direction of the ice tray on which any other member is not required to be formed.

Further, it is preferable that the ice making device further includes an ice tray drive part for turning and elastically deforming the ice tray to a state that an opening of the ice tray is directed downward after the water in the ice tray is detected to be frozen, and the electrode of the electrostatic capacity sensor is attached to the ice tray in a tightly contacted state with the ice tray and in a state that the electrode is attached to the ice tray through a displacement absorption member which is capable of being elastically deformed.

In a so-called "twist type" ice making device in which the ice tray is twisted and deformed to drop ice pieces, the electrode of the electrostatic capacity sensor attached to the ice tray may be damaged due to its large deformation together with the twisted deformation of the ice tray. However, According to this structure, even when the ice tray is deformed, a displacement absorption member which can be deformed easier (softer) than the ice tray is disposed on an outer side of the electrode and thus the electrode is prevented from being largely deformed together with the deformation of the ice tray. Further, since the electrode is not required to be deformed largely, a thickness and material of the electrode can be selected freely. In addition, the electrode hardly affects easy deformability of the entire ice tray including the electrode and thus a torque of a motor for deforming the ice tray can be made small.

Further, it is preferable that the ice making device further includes an ice tray drive part for turning and elastically deforming the ice tray to a state that an opening of the ice tray is directed downward after the water in the ice tray is detected to be frozen, and an electrode moving part for setting in a state that the electrode of the electrostatic capacity sensor is abutted with the ice tray when water is supplied to the ice tray through the water-supply part and when the water in the ice tray is not frozen yet and, after the water in the ice tray has been frozen and when the ice tray is turned by the ice tray drive part, the electrode moving part moves the electrode of the electrostatic capacity sensor to a position where the electrode of the electrostatic capacity sensor is not located at a turning locus of the ice tray.

According to this structure, when the ice tray is being turned, in other words, when the ice separating operation is being performed, the electrode is not contacted with the ice tray. In other words, since the electrode is not deformed by elastic deformation of the ice tray, the damage of the electrode due to its deformation is prevented. Further, since the electrode is not required to be deformed, a thickness and material of the electrode can be selected freely. In addition, the electrode hardly affects easy deformability of the entire ice tray including the electrode and thus a torque of a motor for deforming the ice tray can be made small.

Further, it is preferable that the ice making device further includes an ice tray drive part for turning and elastically deforming the ice tray to a state that an opening of the ice tray is directed downward after the water in the ice tray is detected to be frozen, and the electrode of the electrostatic capacity sensor is pressed against an outer face of the ice tray by an urging member which is provided on an outer side of the electrode.

According to this structure, even when the ice tray is elastically deformed, an urging member which is easier to deform (softer) than the ice tray is provided on the outer side of the electrode and thus the electrode pushes the urging member aside to try to maintain its state (natural state) as it is. In other words, the electrode is not deformed depending on the deformed quantity of the ice tray and thus the damage of the electrode due to its large deformation is prevented. Further, since the electrode is not required to be deformed largely, a thickness and material of the electrode can be selected freely. In addition, the electrode hardly affects easy deformability of the entire ice tray including the electrode and thus a torque of a motor for deforming the ice tray can be made small.

Further, it is preferable that the water-supply part is provided with one water-supply port, the ice tray is formed with a plurality of cells each of which makes one ice piece, a flow passage is formed between adjacent cells to each other, and the electrodes of the electrostatic capacity sensor are attached at positions so as to interpose one or plural cells located at a remotest position from one or plural cells located at a nearest position to the water-supply port of the water-supply part.

According to this structure, when water is supplied to the ice tray, the cell to which the electrode is attached is the cell into which water is finally flowed (a predetermined quantity of water is finally stored in the ice tray). In other words, it is detected by the cell into which water is finally flowed whether a predetermined quantity of water is existed or not. As a result, when it is detected by the electrostatic capacity sensor that a predetermined quantity of water is existed in the cell into which water is finally flowed (when the measured electrostatic capacity value becomes not less than the first threshold value), it is understood that a predetermined quantity of water is existed in other cells. Therefore, a water-supply quantity to the ice tray can be controlled accurately by controlling the water-supply quantity through the variation of the electrostatic capacity of the cell into which water is flowed finally.

Further, it is preferable that the ice making device further includes an ice frozen detecting section for detecting water supplied to the ice tray through the water-supply part having been frozen on the basis of the variation of the electrostatic capacity between the electrodes of the electrostatic capacity sensor.

According to this structure, it is detected by the electrostatic capacity sensor, which is used to control the water-supply quantity to the ice tray, whether the water supplied to the ice tray has been frozen or not (whether ice pieces are completed or not). Therefore, the ice separating operation is prevented from being performed in a state that the water supplied to the ice tray is not frozen completely.

Further, it is preferable that the ice making device further includes an ice dropped detecting section for detecting that ice pieces have been dropped from the ice tray on the basis of the variation of the electrostatic capacity between the electrodes of the electrostatic capacity sensor.

According to this structure, it is detected by the electrostatic capacity sensor, which is used to control the water-supply quantity to the ice tray, that ice pieces in the ice tray have been dropped (the ice tray is in an empty state). Therefore, it is prevented that, after the ice separating operation has been performed, although ice pieces are left in the ice tray, a water-supply operation is performed and water is overflowed from the ice tray.

According to the ice making device in accordance with at least an embodiment of the present invention, a water quantity in the ice tray is capable of being detected by variation of the electrostatic capacity between the electrodes of the electrostatic capacity sensor without being affected due to a shake by the ice tray and by variation of an ambient temperature. Further, a state that the water has been frozen can be detected by variation of the electrostatic capacity between the electrodes of the electrostatic capacity sensor.

Further, according to at least an embodiment of the present invention, an ice making device with a simple structure and its control method can be attained in which a series of operations from a process of water-supply to the ice tray (control of a water-supply quantity) to a process for storing completed ice pieces in an ice storage container is performed accurately.

Other features and advantages of the invention will be apparent from the following detailed description, taken in conjunction with the accompanying drawings that illustrate, by way of example, various features of embodiments of the invention.

BRIEF DESCRIPTION OF THE DRAWINGS

Embodiments will now be described, by way of example only, with reference to the accompanying drawings which are meant to be exemplary, not limiting, and wherein like elements are numbered alike in several Figures, in which.

DETAILED DESCRIPTION OF THE PREFERRED EMBODIMENTS

Figure 1:
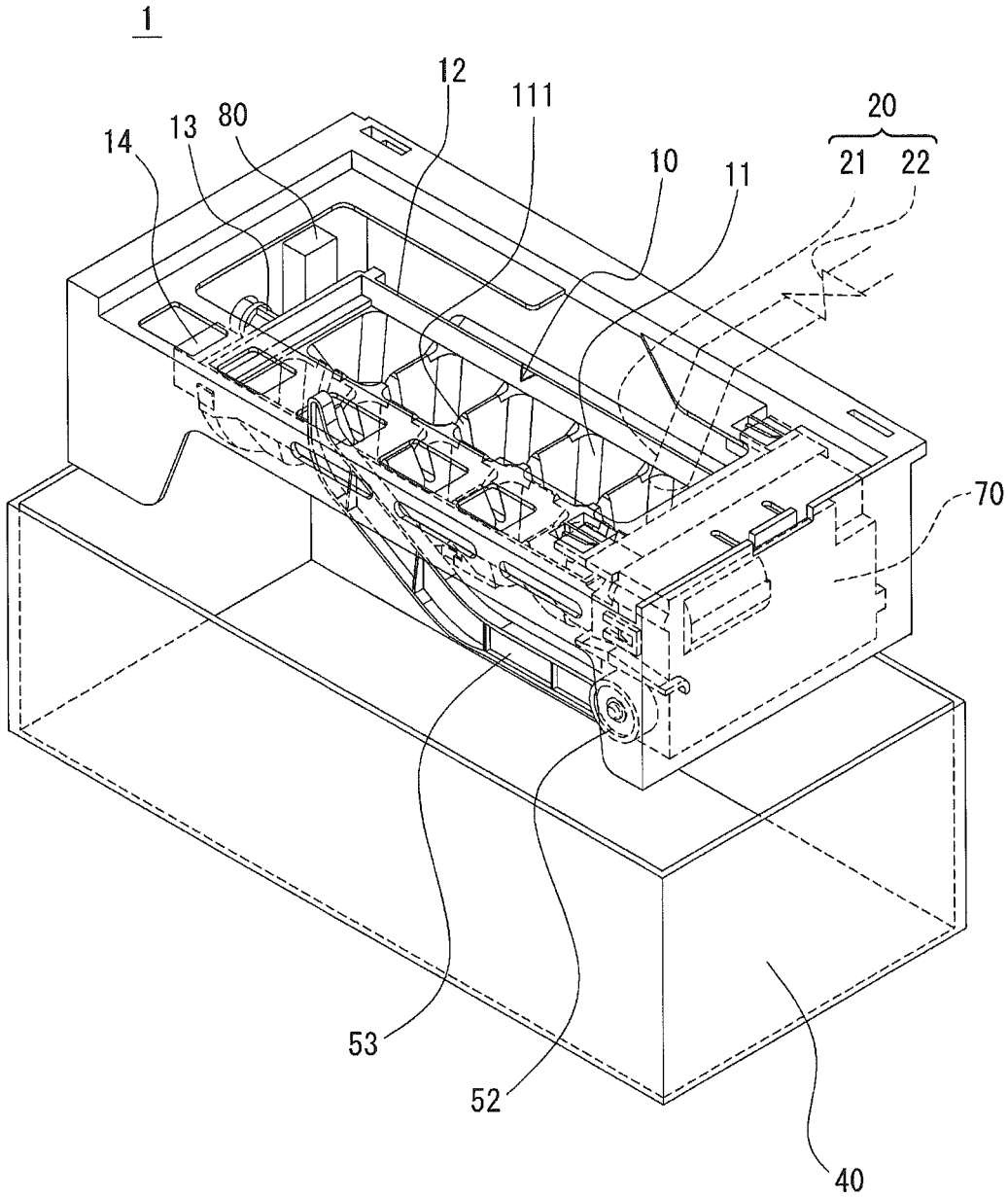
FIG. 1 is an outward appearance view showing an ice making device in accordance with an embodiment of the present invention.
Figure 2:
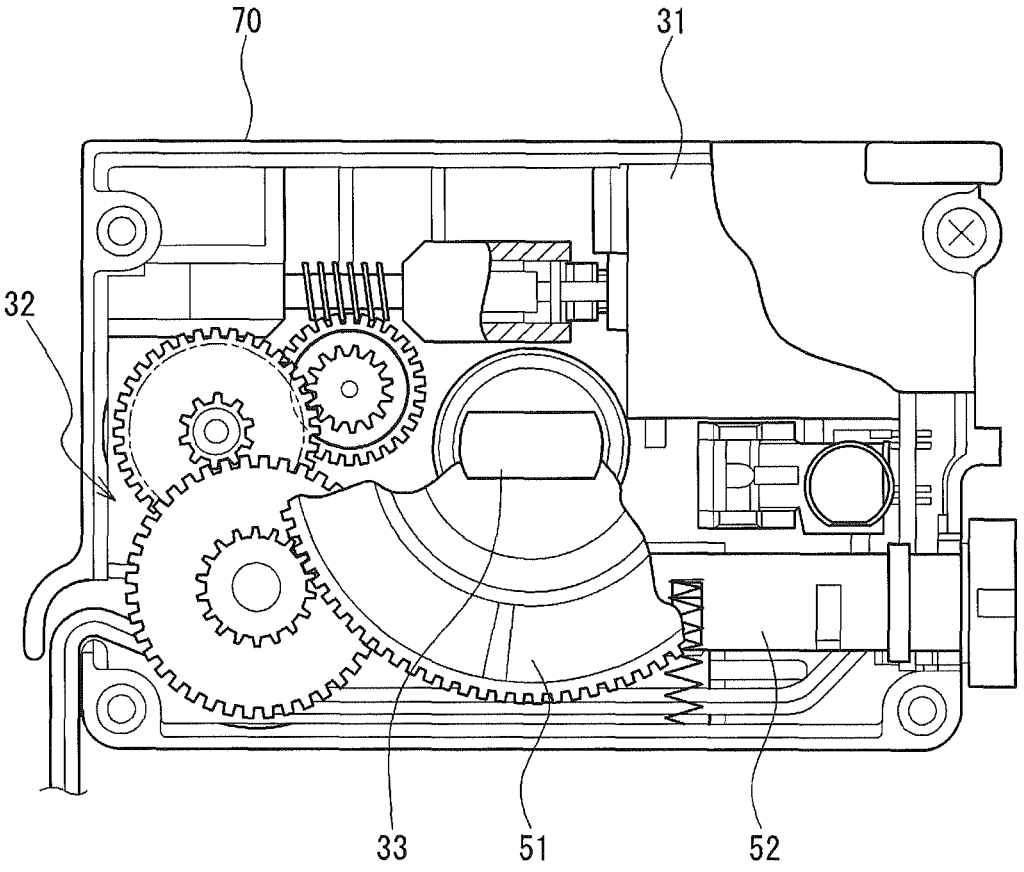
FIG. 2 is a view showing an inside of a box into which members structuring an ice tray drive part and an ice detecting part provided in the ice making device shown in FIG. 1 are accommodated.

An embodiment of the present invention will be described in detail below. An ice making device 1 in accordance with an embodiment of the present invention is a so-called "twist type" ice making device 1 in which an ice tray 10 is twisted and deformed to make ice pieces in the ice tray 10 drop into an ice storage container 40. A home position in the following description is in a state where an opening of the ice tray 10 (openings of respective cells 11) is directed substantially upward.

First, an entire structure of the ice making device 1 will be described below. The ice making device 1 includes the ice tray 10, a water-supply part 20 for supplying water to the ice tray 10, an ice tray drive part for turning the ice tray 10, an ice storage container 40 for storing ice pieces, an ice detecting part for detecting whether an ice quantity in the ice storage container is not less than a predetermined quantity or not, an electrostatic capacity sensor 60 which is attached to the ice tray 10, and a control unit not shown which controls the water-supply part 20, the ice tray drive part, the ice detecting part and the like.

The ice tray 10 is an elastically deformable member which is integrally molded of resin material which is an insulator. The ice tray 10 is formed with a plurality of cells 11 each of which makes one ice piece (in this embodiment, 2×5=10 pieces), and a flow passage 111 is formed between the cells 11 adjacent to each other. Therefore, water flowed into one cell 11 is flowed into adjacent cells 11 through the flow passages 111.

Further, a wall part 12 is continuously formed at an upper part of the ice tray 10 (upper parts of the respective cells 11) in a circumferential direction. Faces along a short side direction of the wall part 12 of the ice tray 10 are formed with a connection part which connects the ice tray 10 with another member. The connection part which is formed on one face along the short side direction is a shaft-shaped part 13 which is turnably supported by a frame body of the device. The connection part which is formed on the other face along the short side direction is a recessed part (not shown) into which an output shaft 33 of the ice tray drive part described in detail below is fitted. In addition, a protruded part 14 is formed on the one face along the short side direction of the ice tray 10. The protruded part 14 is formed at a position so that, when the ice tray 10 is turned by the ice tray drive part from the home position to a state where its opening is directed downward (substantially 180 degrees), the protruded part 14 is abutted with an abutting piece 80 which is formed on the device frame body. In other words, when the ice tray 10 is turned to the state where its opening is directed downward, the protruded part 14 is abutted with the abutting piece 80 to be twisted and deformed (elastically deformed). Ice pieces having been frozen in the respective cells 11 are dropped into the ice storage container 40 due to the deformation.

The water-supply part 20 is provided with a structure for supplying water to the ice tray 10 and includes a water-supply port 21 and a valve 22 provided on an upstream side with respect to the water-supply port 21. The control unit is capable of executing an operation for opening and closing the valve 22 of the water-supply part 20. In other words, the control unit controls whether water is supplied to the ice tray 10 through the water-supply port 21 or the water is stopped.

The ice tray drive part is provided with a structure for turning the ice tray 10 from the home position to an ice separating position. When the ice tray 10 is capable of being turned by substantially 180 degrees from the home position (when turned to the ice separating position), any structure can be applied to the ice tray drive part. In this embodiment, the same structure as the structure described in Japanese Patent Laid-Open No. 2001-304733 is utilized as the ice tray drive part. In other words, a structure is applied to this embodiment in which a drive force of a motor 31 as a drive source is transmitted to an output shaft 33 through a gear train 32 and, when the output shaft 33 is turned, the ice tray 10 connected with the output shaft 33 is turned. The ice tray drive part is controlled by the control unit. In other words, the motor 31 which is a drive source is controlled by the control unit.

The ice storage container 40 is a box-shaped member which is located on a lower side of the ice tray 10. Therefore, all ice pieces dropped by the twisted deformation of the ice tray 10 which has been turned by substantially 180 degrees are stored in the ice storage container 40.

The ice detecting part detects whether an ice quantity in the ice storage container 40 is not less than a predetermined quantity or not, in other words, whether ice pieces in the ice storage container 40 are sufficiently stored or not. When the ice detecting part is capable of detecting whether ice pieces are stored in not less than a predetermined quantity in the ice storage container 40 or not, any structure may be applied to the ice detecting part. In this embodiment, the same structure as the structure described in Japanese Patent Laid-Open No. 2001-304733 is utilized as the ice detecting part, which will be briefly described below.

In the ice detecting part, the motor 31 which is a drive source for the ice tray drive part is utilized as the drive source. Similarly to the ice tray drive part, a drive force of the motor 31 is transmitted to a cam wheel 51 (integrally structured with the output shaft 33) through the gear train 32. When the cam wheel 51 is turned, an ice detecting shaft 52 engaged with a cam which is formed on an inner side of the cam wheel 51 is turned (detail structure is omitted). The ice detecting shaft 52 is connected with an ice detecting member 53 which is located on an upper side of the ice storage container 40 and thus, the ice detecting member 53 is moved downward by turning of the ice detecting shaft 52. In this case, when ice pieces are stored in not less than a predetermined quantity in the ice storage container 40, the downward movement of the ice detecting member 53 to a position lower than a predetermined height is disturbed by the ice pieces in the ice storage container 40 and, as a result, a button of a push switch not shown is pressed to generate a signal. In other words, a signal is generated which indicates that ice pieces in the ice storage container 40 are stored in not less than a predetermined quantity. On the other hand, when ice pieces less than the predetermined quantity are stored in the ice storage container 40, the downward movement of the ice detecting member 53 to a position lower than the predetermined height is not disturbed and thus the button of the push switch is not pressed. In other words, when a signal that the button of the push switch is pressed is not generated, the quantity of the ice pieces in the ice storage container 40 is not more than the predetermined quantity.

The ice detecting part (except the ice detecting member 53) having the structure as described above is accommodated within the box 70 together with the ice tray drive part and is oppositely disposed to the face of the ice tray 10 in the short side direction.

Figure 3:
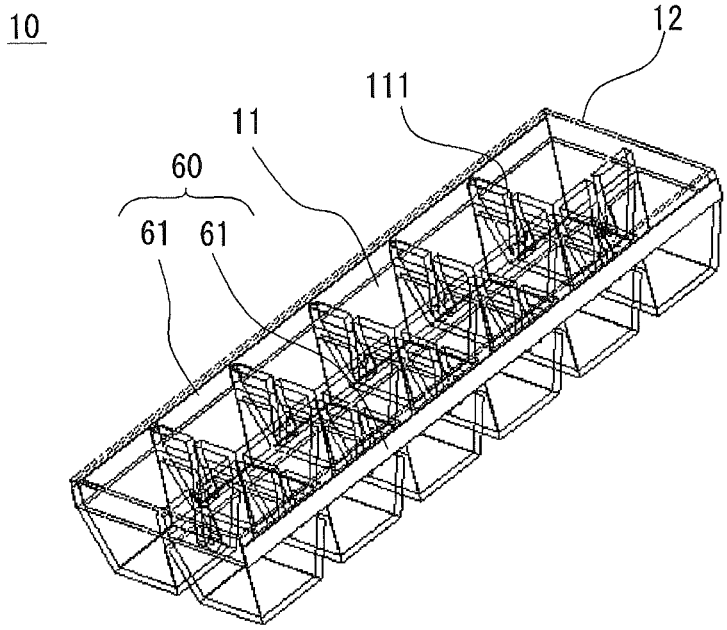
FIG. 3 is a view schematically showing an ice tray (a shaft-shaped part and a protruded part are not shown) in which electrodes of an electrostatic capacity sensor are attached along two faces in a longitudinal direction of the ice tray oppositely disposed to each other.

The electrostatic capacity sensor 60 is provided with two or more electrodes 61 (electric conductor) which are attached to the ice tray 10. The electrodes 61 are respectively insulated. The electrostatic capacity sensor 60 detects an electrostatic capacity between the electrodes 61 which is varied by a dielectric constant of an insulator existing between the electrodes 61. In other words, the electrostatic capacity sensor 60 is a sensor for determining a state of the inside of the ice tray 10 (whether air is existed in the inside of the ice tray 10 (empty), or water or ice pieces are existed in the inside of the ice tray 10, and their quantities and the like). Specifically, the dielectric constant of air is about 1.0, the dielectric constant of water is about 80 and the dielectric constant of ice is about 4.2. Therefore, the electrostatic capacity sensor 60 is a sensor for determining a state of the inside of the ice tray 10 on the basis of variation of the electrostatic capacity due to differences of the dielectric constants. Shape and attaching position of the electrostatic capacity sensor 60 and a detailed function of the sensor 60 will be described below. For example, as shown in FIG. 3, the electrodes 61 of the electrostatic capacity sensor 60 are attached to two faces of the ice tray 10 along the longitudinal direction so as to face each other.

As described above, the control unit controls the water-supply part 20, the ice tray drive part and the ice detecting part. In addition, the control unit includes a water quantity detecting section which detects a water quantity in the ice tray 10 on the basis of variation of the electrostatic capacity between the electrodes 61 of the electrostatic capacity sensor 60, an ice frozen detecting section which detects that the water in the ice tray 10 has been frozen (ice pieces are existed in the ice tray 10) on the basis of variation of the electrostatic capacity between the electrodes 61 of the electrostatic capacity sensor 60, and an ice dropped detecting section which detects that no ice piece is existed (air is existed in the ice tray 10) on the basis of variation of the electrostatic capacity between the electrodes 61 of the electrostatic capacity sensor 60. The water quantity detecting section, the ice frozen detecting section and the ice dropped detecting section may be collectively referred to as a detecting section. These detecting sections may be structured so as to be collectively mounted on one controller or these functions may be divided into a plurality of controllers to be mounted.

An operation of the ice making device 1 including the above-mentioned structure, in other words, an operational control of the control unit will be described below with reference to the time chart in FIG. 4 and the flow charts in FIGS. 5 and 6. In the ice making device 1 having the structure as described above, when the control unit (program and detecting section) and the electrostatic capacity sensor 60 are changed, both of a first operational example and a second operational example can be applied to the ice making device 1.

First Operational Example

Normal Operation

A first operational example will be described below. In the first operational example, operations from a first process to a fourth process are repeated sequentially.

Figure 5:
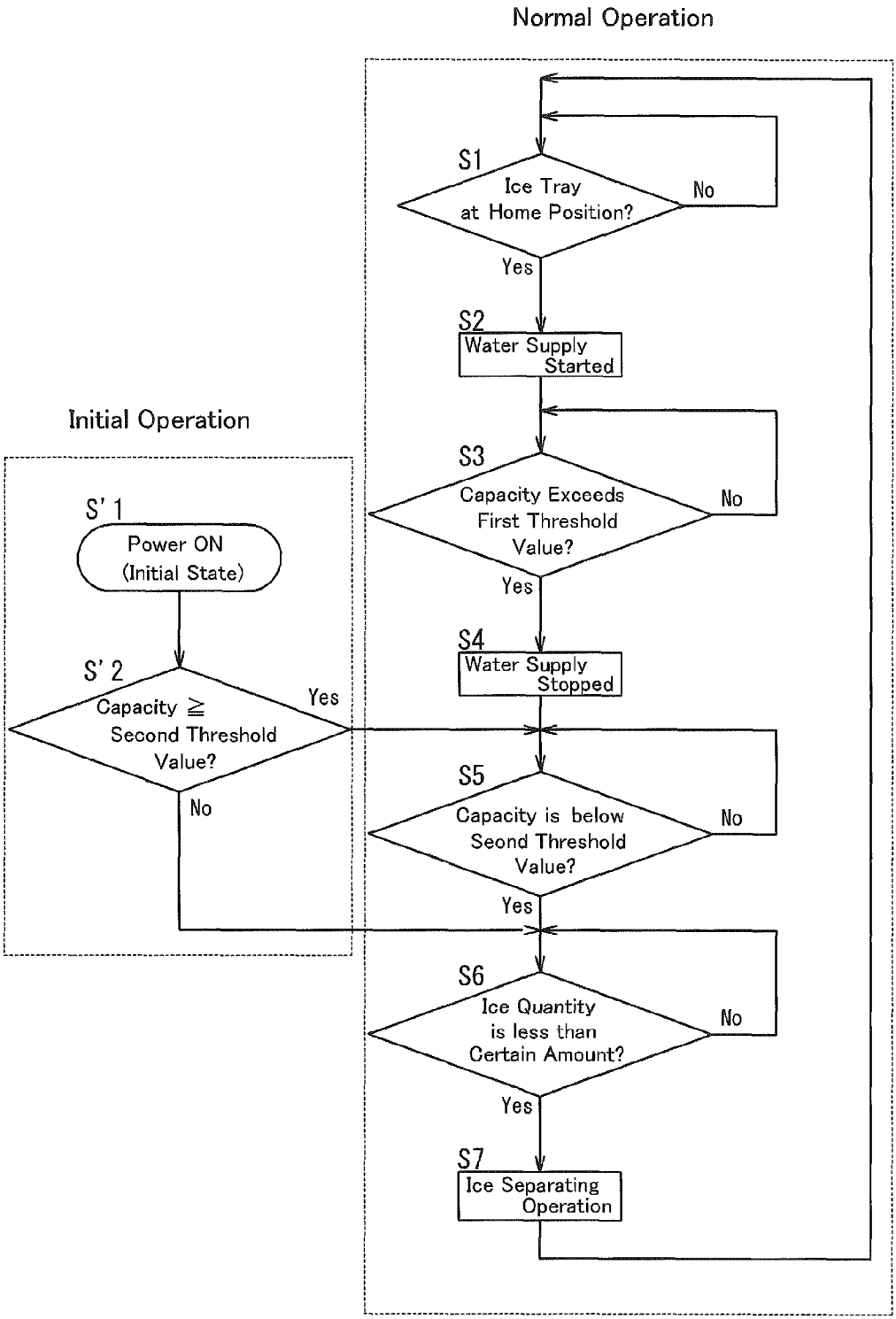
FIG. 5 is a flow chart for explaining an operation of an ice tray (a first operational example).

In the first process, after an ice separating operation has been completed, it is confirmed that the ice tray 10 is located at the home position, in other words, that the ice tray drive part is located at the home position ("S1" in FIG. 5). Any method and structure for confirmation may be utilized. For example, it is determined whether the ice tray 10 is located at the home position or not by detecting a turning position of the cam wheel 51 which is integrally turned with the output shaft 33 connected with the ice tray 10. After it is determined that the ice tray 10 is located at the home position ("S1" is "Yes" in FIG. 5), water supply by the water-supply part 20 is started ("S2" in FIG. 5). In other words, the valve 22 of the water-supply part 20 is opened and water is flowed into the ice tray 10 through the water-supply port 21. In this manner, the first process is finished.

A second process is a process in which a predetermined quantity of water is flown into the ice tray 10. Specifically, as a water-supply time period is passed, a quantity of the air (dielectric constant is about 1.0) occupying the ice tray 10 is decreased and a quantity of water (dielectric constant is about 80) is increased and thus an electrostatic capacity value which is measured by the electrostatic capacity sensor 60 is increased. The water supply by the water-supply part 20 is continued until the electrostatic capacity value measured by the electrostatic capacity sensor 60 exceeds a first threshold value (see FIG. 4) and, when the water quantity detecting section detects that the measured electrostatic capacity value exceeds the first threshold value ("S3" is "Yes" in FIG. 5), it is determined that the predetermined quantity of water has been flowed into the ice tray 10 and the water supply by the water-supply part 20 is stopped ("S4" in FIG. 5).

In this embodiment, the first threshold value is a value which is determined on the basis of an electrostatic capacity value in a state that a predetermined quantity of water is existed in the ice tray 10. Specifically, the first threshold value is an electrostatic capacity value in a state that a quantity of water required for a size of ice piece to be made is existed in the ice tray 10. The electrostatic capacity value corresponding to the first threshold value is varied with the specifications of the device such as the ice tray 10 and arrangement of the electrodes 61 of the electrostatic capacity sensor 60 to be used. Therefore, after the specifications of the device have been determined, an electrostatic capacity value is previously measured in the state that a predetermined quantity of water is existed in the ice tray 10 and the value having been measured is set as the first threshold value. As described above, when the second process has been finished, a quantity of water required for a size of ice piece to be made is existed in the ice tray 10.

In a third process, first, the ice making device 1 stands by until the predetermined quantity of the water flowed into the ice tray 10, which is set under an environment below the freezing point (below 0 degrees Centigrade), has been frozen. Specifically, as a stand-by time after the second process has been finished is passed, the water in the ice tray 10 (dielectric constant is about 80) is changed to ice (dielectric constant is about 4.2), i.e., the water is gradually frozen and thus, the electrostatic capacity value measured by the electrostatic capacity sensor 60 is decreased. After that, in response to that the electrostatic capacity value measured by the frozen ice detecting section becomes below the second threshold value (see FIG. 4) ("S5" is "Yes" in FIG. 5), it is determined that all the water in the ice tray 10 has been frozen to ice pieces.

In this embodiment, the second threshold value is a value which is set on the basis of an electrostatic capacity value in the state that all of the predetermined quantity of the water in the ice tray 10 has been frozen to ice pieces. Specifically, the second threshold value is the electrostatic capacity value in the state that all of the predetermined quantity of the water in the ice tray 10 has been frozen to ice pieces or the value in which a safety value is added to the electrostatic capacity value. The electrostatic capacity value for setting the second threshold value is varied with the specifications of the device such as the ice tray 10 and arrangement of the electrodes 61 of the electrostatic capacity sensor 60 to be used. Therefore, after the specifications of the device have been determined, an electrostatic capacity value is previously measured in the state that the predetermined quantity of the water in the ice tray 10 has been frozen to ice pieces and then, the measured value or the value in which a safety value is added to the measured value is set as the second threshold value. In this embodiment, the safety value is a value for preventing malfunction due to a measurement error. For example, in a case that an electrostatic capacity value in a state that all of a predetermined quantity of water previously measured in the ice tray 10 has been frozen to ice pieces is set as the second threshold value as it is, when a measurement error is occurred in an electrostatic capacity value which is measured by the electrostatic capacity sensor 60 in the third process during operation of the ice making device 1, the electrostatic capacity value may not be lowered to the second threshold value (may not be below the second threshold value) even when all of the water in the ice tray 10 has been frozen to ice pieces. Therefore, an electrostatic capacity value slightly higher than the electrostatic capacity value in the state that all of the predetermined quantity of the water measured previously in the ice tray 10 has been frozen to ice pieces may be set as the second threshold value. In other words, an electrostatic capacity value which is added with a safety value may be set as the second threshold value. Which electrostatic capacity value is used as the second threshold value may be determined depending on accuracy and the like of the electrostatic capacity sensor 60 to be used. In other words, whether the electrostatic capacity value in the state that all of the predetermined quantity of the water measured previously in the ice tray 10 has been frozen to ice pieces is set as the second threshold value as it is or, whether the electrostatic capacity value which is added with a safety value is set as the second threshold value may be determined depending on accuracy and the like of the electrostatic capacity sensor 60 to be used. Further, in a case that the electrostatic capacity value which is added with a safety value is set as the second threshold value, there is a possibility that a state may occur in which the water has not been frozen completely even when a measured electrostatic capacity value is below the second threshold value. Therefore, it may be controlled that, after a measured electrostatic capacity value becomes below the second threshold value and then, after a predetermined time period has passed, the ice detecting operation described below is performed.

After the ice frozen detecting section has detected that the electrostatic capacity value becomes below the second threshold value, an ice detecting operation by the ice detecting part is started. As described above, when ice pieces are existed less than a predetermined quantity in the ice storage container 40, downward movement of the ice detecting member 53 is not disturbed to a lower position than a predetermined height. Therefore, even when the ice detecting shaft 52 is turned more than a predetermined quantity, the button of the push switch not shown is not pressed and thus a signal is not generated. As described above, after the ice detecting shaft 52 is turned more than the predetermined quantity (the motor 31 is turned in one direction in a predetermined time period), when it is detected that the button of the push switch not shown is not pressed, in other words, when it is detected that the quantity of ice pieces in the ice storage container 40 is less than a certain amount ("S6" is "Yes" in FIG. 5), an ice separating operation by the ice tray drive part is started ("S7" in FIG. 5). In other words, an ice separating operation by the ice tray drive part is started in response to that it is detected that the electrostatic capacity value becomes below the second threshold value and that the quantity of ice pieces in the ice storage container 40 is less than a certain amount. In other words, the motor 31 is rotated in one direction so that the ice tray 10 is turned by about 180 degrees to be twisted and deformed and thus ice pieces are dropped into the ice storage container 40. In addition, any method may be utilized for confirming that the ice tray 10 has been turned about 180 degrees (the ice tray 10 has been turned to the ice separating position). For example, a similar method to the method for confirming the ice tray 10 located at the home position may be utilized. In this manner, the third process is finished.

In a fourth process, the ice tray 10 is returned to the home position ("S1" in FIG. 5). In other words, the motor 31 is rotated in the other direction (reversely rotated) and the ice tray 10 is returned to the home position. After that, the operation of the first process is started again. As described above, in the first operational example, operations of the first process through the fourth process are executed repeatedly.

First Operational Example

Initial Operation

An initial operation when the first operational example is adopted will be described below. The initial operation is an operation when the control unit (detecting section) is initialized. The control unit is, for example, initialized at a time when the product is purchased or when energization to the control unit is recovered from a stopped state due to a power failure or the like.

In the initial state (initialized state) ("S'1" in FIG. 5), when the measured electrostatic capacity value is not less than the second threshold value ("S'2" is "Yes" in FIG. 5), first, the operation of the third process is executed. In other words, when the measured electrostatic capacity value is not less than the second threshold value, water is existed in the ice tray 10 (which includes a state that the water is not frozen completely and both of water and ice are existed) and thus, the control unit stands by until the water in the ice tray 10 has been frozen. After that, the ice separating operation is executed in response to that the water in the ice tray 10 has been frozen, in other words, that the ice frozen detecting section detects that the measured electrostatic capacity value becomes below the second threshold value. After the operation of the third process has been executed as described above, the normal operation is executed in the above-mentioned order as the fourth process, the first process, the second process, and so on. As described above, when the electrostatic capacity value measured in the initial state is not less than the second threshold value, the water being left in the ice tray 10 is made to be frozen and, after ice pieces having been made are separated by the ice separating operation, the control unit is returned to the normal operation.

On the other hand, in the initial state, when the measured electrostatic capacity value is below the second threshold value ("S'2" is "No" in FIG. 5), and it is detected by the ice detecting part that the quantity of ice pieces in the ice storage container 40 is less than a certain amount, first, the ice separating operation is executed by the ice tray drive part. In other words, when the measured electrostatic capacity value is below the second threshold value, ice pieces are existed in the ice tray 10 (a state that the water has been frozen completely) or, the inside of the ice tray 10 is empty (a state that air is existed in the inside of the ice tray 10). Therefore, on the assumption that ice pieces are existed, the ice tray drive part is operated for executing the ice separating operation. In other words, when ice pieces are actually existed in the ice tray 10, the ice pieces are separated by the ice separating operation and a state is obtained that the inside of the ice tray 10 is empty, and alternatively, when the ice tray 10 is in an empty state, the empty state of the ice tray 10 is not changed (the ice tray 10 in an empty state is simply turned). As described above, in both of the state that ice pieces are actually existed in the ice tray 10 and the state that the ice tray 10 is empty, the ice tray 10 becomes an empty state by executing the ice separating operation. After the ice separating operation is performed, the normal operation is performed in the above-mentioned order as the fourth process, the first process, the second process, and so on. As described above, when the measured electrostatic capacity value in the initial state is below the second threshold value, and it is detected by the ice detecting part that the quantity of ice pieces in the ice storage container 40 is less than the certain amount, after the ice pieces left in the ice tray 10 are separated by the ice separating operation, the control unit is returned to the normal operation.

Second Operational Example

Normal Operation

A second operational example will be described below. In the second operational example, operations from a first process to a fourth process are repeated sequentially. As described below, the second operational example is different from the first operational example in a point that a third threshold value is set.

Figure 6:
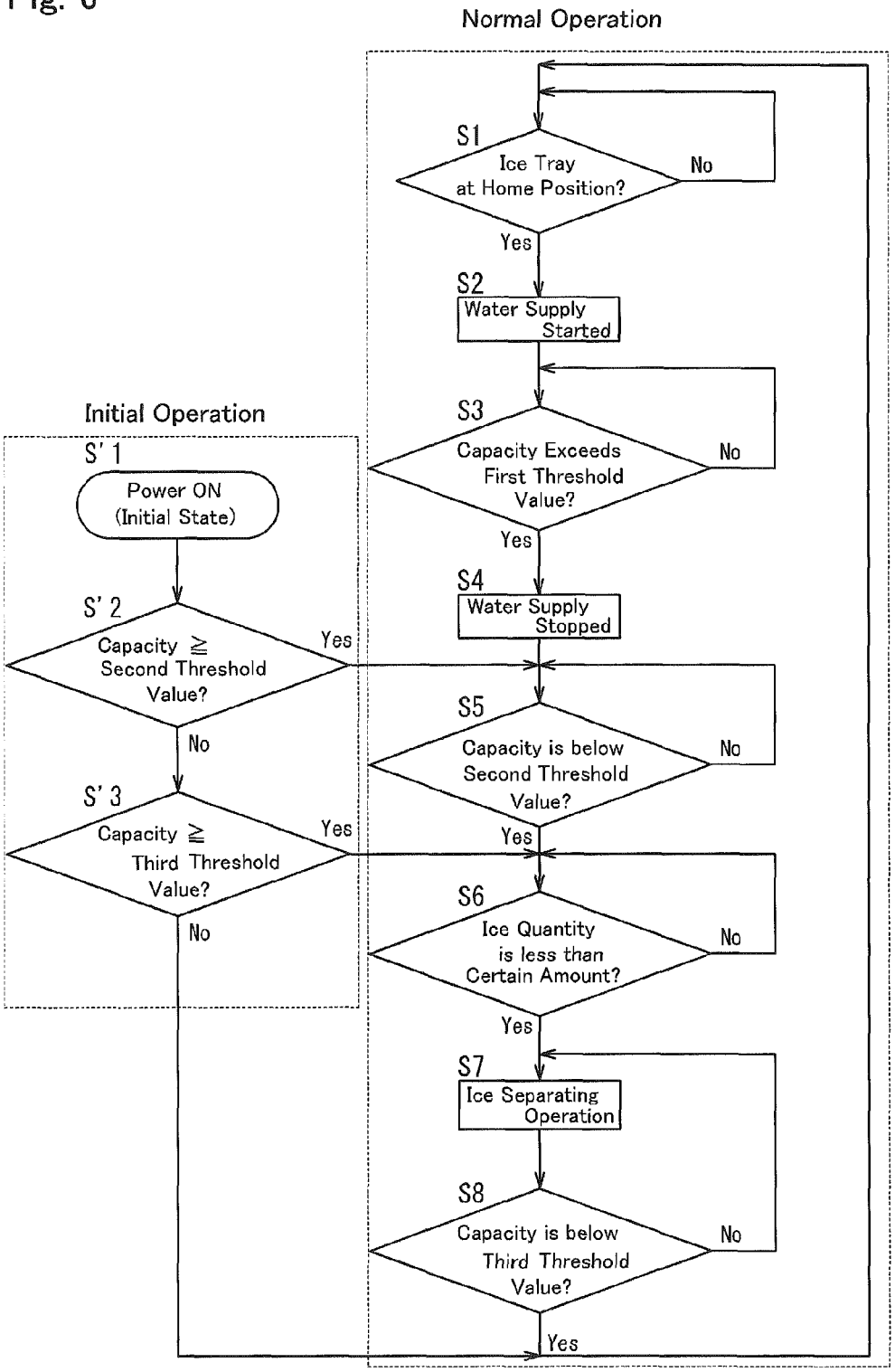
FIG. 6 is a flow chart for explaining an operation of an ice tray (a second operational example).

In the first process, first, it is confirmed that the ice tray 10 is located at the home position, in other words, that the ice tray drive part is located at the home position ("S1" in FIG. 6). Similarly to the first operational example, any method and structure for confirmation may be utilized. After it is determined that the ice tray 10 is located at the home position, water supply is started by the water-supply part 20 ("S2" in FIG. 6). In other words, the valve 22 of the water-supply part 20 is opened and water is flowed into the ice tray 10 through the water-supply port 21. In this manner, the first process is finished.

A second process is a process in which a predetermined quantity of water is flown into the ice tray 10. Specifically, as a water-supply time period is passed, a quantity of the air (dielectric constant is about 1.0) occupying the ice tray 10 is decreased and a quantity of water (dielectric constant is about 80) is increased and thus an electrostatic capacity value which is measured by the electrostatic capacity sensor 60 is increased. The water supply is continued by the water-supply part 20 until the electrostatic capacity value measured by the electrostatic capacity sensor 60 exceeds the first threshold value (see FIG. 4) and, in response to that the water quantity detecting section detects that the measured electrostatic capacity value exceeds the first threshold value ("S3" is "Yes" in FIG. 6), it is determined that the predetermined quantity of water has been flowed into the ice tray 10 and the water supply by the water-supply part 20 is stopped ("S4" in FIG. 6).

Similarly to the first operational example, the first threshold value is a value which is determined on the basis of an electrostatic capacity value in a state that a predetermined quantity of water is existed in the ice tray 10. The setting technique for the first threshold value may utilize the similar technique in the first operational example. Therefore, when the second process is finished, a quantity of water required for a size of ice piece to be made is existed in the ice tray 10.

In a third process, first, the control unit stands by until the predetermined quantity of the water flowed into the ice tray 10 has been frozen. Specifically, as a stand-by time period after the second process is finished is passed, the water in the ice tray 10 (dielectric constant is about 80) is changed to ice (dielectric constant is about 4.2), i.e., the water is gradually frozen and thus, the electrostatic capacity value measured by the electrostatic capacity sensor 60 is decreased. After that, in response to that it is detected by the ice frozen detecting section that the electrostatic capacity value measured by the electrostatic capacity sensor 60 becomes below the second threshold value (see FIG. 4) ("S5" is "Yes" in FIG. 6), it is determined that all the water in the ice tray 10 has been frozen to ice pieces.

Similarly to the first operational example, the second threshold value is a value which is set on the basis of an electrostatic capacity value in the state that all of the predetermined quantity of the water in the ice tray 10 has been frozen to ice pieces. The setting technique for the second threshold value may utilize the similar technique in the first operational example. Whether a value added with a safety value is set as the second threshold value or not is appropriately selectable.

After it is detected that the electrostatic capacity value measured by the electrostatic capacity sensor 60 becomes below the second threshold value, an ice detecting operation is started by the ice detecting part. Similar technique in the first operational example may be utilized as the ice detecting operation. When it is detected that the quantity of ice pieces in the ice storage container 40 is less than a certain amount ("S6" is "Yes" in FIG. 6), an ice separating operation is started by the ice tray drive part ("S7" in FIG. 6). In other words, an ice separating operation is started by the ice tray drive part in response to that it is detected that the electrostatic capacity value becomes below the second threshold value and that the quantity of ice pieces in the ice storage container 40 is less than a certain amount. In other words, the motor 31 is rotated in one direction so that the ice tray 10 is turned by about 180 degrees to be twisted and deformed and thus ice pieces are dropped into the ice storage container 40. In this manner, the third process is finished.

In a fourth process, the ice tray 10 is returned to the home position. In other words, the motor 31 is rotated in the other direction (reversely rotated) and the ice tray 10 is returned to the home position. After that, it is determined whether the inside of the ice tray 10 is in a empty state (air is existed; dielectric constant is about 1.0) or not. Specifically, it is confirmed whether the measured electrostatic capacity value is below a third threshold value (see FIG. 4) or not ("S8" in FIG. 6).

The third threshold value is a value which is set on the basis of an electrostatic capacity value in the state that the ice tray 10 is empty. Specifically, the third threshold value is a value between the electrostatic capacity value in the state that the ice tray 10 is completely empty and the electrostatic capacity value in the state that an ice piece is left in at least one of the cells 11 of the ice tray 10. The electrostatic capacity value for setting the third threshold value is varied with the specifications of the device such as the ice tray 10 and arrangement of the electrodes 61 of the electrostatic capacity sensor 60 to be used. Therefore, after the specifications of the device have been determined, electrostatic capacity values are previously measured in the state that the ice tray 10 is empty and in the state that an ice piece is left in at least one of the cells 11 of the ice tray 10 and the third threshold value is determined on the basis of the measured values.

After the ice tray 10 has been returned to the home position, when it is confirmed by the ice dropped detecting section that the measured electrostatic capacity value is below the third threshold value ("S8" is "Yes" in FIG. 6), the ice tray 10 is empty and ice pieces in the ice tray 10 has been completely dropped through the ice separating operation. Therefore, the operation of the first process is started again. On the other hand, after the ice tray 10 has been returned to the home position, when the measured electrostatic capacity value is not less than the third threshold value ("S8" is "No" in FIG. 6), ice pieces are left in the ice tray 10 and thus the ice separating operation is performed by the ice tray drive part again. After that, the ice tray 10 is returned to the home position and it is determined whether the measured electrostatic capacity value is below the third threshold value or not again. When the measured electrostatic capacity value is below the third threshold value, the ice pieces in the ice tray 10 are completely dropped through the ice separating operation which has been performed again and thus the operation of the first process is started.

Second Operational Example

Initial Operation

An initial operation when the second operational example is adopted will be described below.

In the initial state (initialized state) ("S'1" in FIG. 6), when the measured electrostatic capacity value is not less than the second threshold value ("S'2" is "Yes" in FIG. 6), similarly to the first operational example, first, the operation of the third process is executed. In other words, when the measured electrostatic capacity value is not less than the second threshold value, water is existed in the ice tray 10 (which includes a state that the water is not frozen completely and both of water and ice are existed) and thus, the control unit stands by until the water in the ice tray 10 has been frozen. After that, the ice separating operation is performed in response to that the water in the ice tray 10 has been frozen, in other words, that the frozen ice detecting section detects that the measured electrostatic capacity value becomes below the second threshold value. After the operation of the third process has been performed as described above, the normal operation is performed in the above-mentioned order as the fourth process, the first process, the second process, and so on. As described above, when the measured electrostatic capacity value is not less than the second threshold value in the initial state, the water left in the ice tray 10 is made to be frozen and, after ice pieces have been separated by the ice separating operation, the control unit is returned to the normal operation.

On the other hand, in the initial state, when the measured electrostatic capacity value is below the second threshold value and not less than the third threshold value ("S'3" is "Yes" in FIG. 6), and it is detected by the ice detecting mechanism that the quantity of ice pieces in the ice storage container 40 is less than a certain amount, first, the ice separating operation is performed by the ice tray drive mechanism. In other words, when the measured electrostatic capacity value is below the second threshold value and not less than the third threshold value, ice pieces are existed in the ice tray 10 (a state that the water has been frozen completely). Therefore, the ice tray drive part is operated so that the ice pieces are separated and dropped. After the ice separating operation, the normal operation is performed in the above-mentioned order as the fourth process, the first process, the second process, and so on. As described above, when the measured electrostatic capacity value in the initial state is below the second threshold value and not less than the third threshold value, and it is detected by the ice detecting mechanism that the quantity of ice pieces in the ice storage container 40 is less than the certain amount, after the ice pieces left in the ice tray 10 are separated and dropped, the control unit is returned to the normal operation.

Further, in the initial state, when the measured electrostatic capacity value is below the third threshold value ("S'3" is "No" in FIG. 6), first, the operation of the first process is performed. In other words, when the measured electrostatic capacity value is below the third threshold value, the inside of the ice tray 10 is empty (a state that air is existed) and thus water supply to the ice tray 10 is started as it is. After the operation of the first process has been performed as described above, the normal operation is performed in the above-mentioned order as the second process, the third process, the fourth process, and so on. As described above, when the electrostatic capacity value measured in the initial state is below the third threshold value, it is determined that the ice tray 10 is in an empty state and the operation of the first process (water-supply operation) is performed.

As described above, the second operational example is different from the first operational example in a point that, after the ice separating operation is performed, it is determined whether the measured electrostatic capacity value is below the third threshold value or not. When the respective operational examples are adopted, the following advantageous effects are obtained.

In the first operational example, the first threshold value based on that the dielectric constant of water is about 80 and the second threshold value based on that the dielectric constant of ice is about 4.2 are set as a threshold value which is a trigger of the operation. In other words, it is detected whether water is existed in the ice tray 10 or ice pieces are existed (a state of ice pieces and an empty state (air) are not distinguished from each other). The dielectric constants of ice and water are largely different from each other and a large difference is existed between both of the threshold values and thus an electrostatic capacity sensor 60 and a detecting section (control unit) having a low degree of measurement accuracy may be used. In other words, the device can be structured to be inexpensive.

Further, even when the state that ice pieces are existed in the ice tray 10 and the state that the ice tray 10 is in an empty state are not distinguished from each other as described above, in a case that the electrostatic capacity value measured in the initial state is below the second threshold value and it is detected by the ice detecting mechanism that the quantity of ice pieces in the ice storage container 40 is less than the certain amount, in both of the cases, when the ice separating operation is firstly performed, after the ice separating operation has been performed, the ice tray 10 becomes in an empty state. Therefore, after the ice separating operation has been performed, the control unit can be returned to the normal operation from the fourth process.

On the other hand, in the second operational example, the third threshold value based on that the dielectric constant of air is about 1.0 is set in addition to the first threshold value and the second threshold value. In other words, the state that the ice tray 10 is empty is also detected and distinguished in addition to the state that water is existed in the ice tray 10 and the state that ice pieces are existed. Therefore, after the ice separating operation is performed, it can be detected whether ice pieces in the ice tray 10 have been completely dropped from the ice tray 10. Therefore, occurrence of malfunction, for example, water supply is started in a state that ice pieces are left in the ice tray 10 to cause water to overflow from ice tray 10 is prevented.

Further, in a case that the state that ice pieces are existed in the ice tray 10 and the state that the ice tray 10 is in an empty state are to be distinguished from each other, when the electrostatic capacity value measured in the initial state is below the third threshold value, the water-supply operation (operation of the first process) is allowed to perform immediately and thus, the operation in which the ice tray 10 in an empty state is turned (ice separating operation which is performed in an empty state of the ice tray 10) is not required like the initial operation of the first operational example.

Further, even when which example is adopted, i.e., the first operational example or the second operational example, both of the examples are superior in the following respects to a conventional structure in which a state within the ice tray 10 is estimated on the basis of temperature change (structure with the use of a temperature sensor).

In a case of the conventional structure in which a state within the ice tray 10 is estimated on the basis of the temperature change, a state in which water is existed in the ice tray 10 cannot be distinguished from a state in which the ice tray 10 is empty and the ice tray 10 itself is relatively warm (state occurring when the product is purchased or when power failure has been occurred for a long time, or the like). Therefore, in this case, it is temporarily supposed that water is existed in the ice tray 10 and the control unit is required to stand by until a sufficient time period for making water become ice pieces has passed to confirm whether the inside of the ice tray 10 is changed into the state that ice pieces are existed or not. In other words, even when the ice tray 10 is actually in an empty state, unless it is confirmed that ice pieces are not existed in the ice tray 10 after a sufficient time period has passed, it cannot be determined that the ice tray 10 is in an empty state. On the other hand, the ice making device 1 in accordance with this embodiment is capable of distinguishing whether water is existed in the ice tray 10 or the ice tray 10 is in an empty state and thus the ice tray 10 in the empty state is not required to be in a standby state in the initial state.

Next, a preferred control example which is commonly applied to the first operational example and the second operational example will be described below.

A first control example is a control method in which, in the third process, the control unit stops energization to the detecting section (ice frozen detecting section) for detecting an electrostatic capacity by the electrostatic capacity sensor 60 for a certain time period from the stoppage of water-supply. In other words, after a predetermined quantity of water is supplied to the ice tray 10, a certain time period is required for the water to be frozen (essential time period is required for making ice pieces which is not dependent on an ambient temperature and the like, hereinafter, referred to as a minimum time period). Therefore, ice pieces are not completed during the minimum time period from the stoppage of water-supply and thus the electrostatic capacity is not required to be detected. Accordingly, when energization to the detecting section is stopped during a certain time period which is at least shorter than the minimum time period, electric power required for detection of the electrostatic capacity is reduced by that amount.

A second control example is a control method in which, in the third process, the control unit stops energization to the detecting section for detecting an electrostatic capacity by the electrostatic capacity sensor 60 during a time period from the measured electrostatic capacity value becomes below the second threshold value till the ice separating operation has been finished. The ice separating operation is not started after it is detected that the measured electrostatic capacity value becomes below the second threshold value and until it is detected by the ice detecting operation that the quantity of ice pieces in the ice storage container 40 is below the certain amount and thus the state that ice pieces are existed in the ice tray 10 is maintained as it is. In some cases, ice pieces are not used at all and the state that the quantity of ice pieces in the ice storage container 40 is not less than the certain amount may continue a long time and thus, during this time period, it is preferable that energization to the detecting section is stopped. Further, it is not required to detect the state within the ice tray 10 during the ice separating operation and thus, although a short time period, it is preferable that energization to the detecting section is stopped during this time period. According to this method, similarly to the first control example, electric power required for detection of the electrostatic capacity is reduced.

Figure 4:
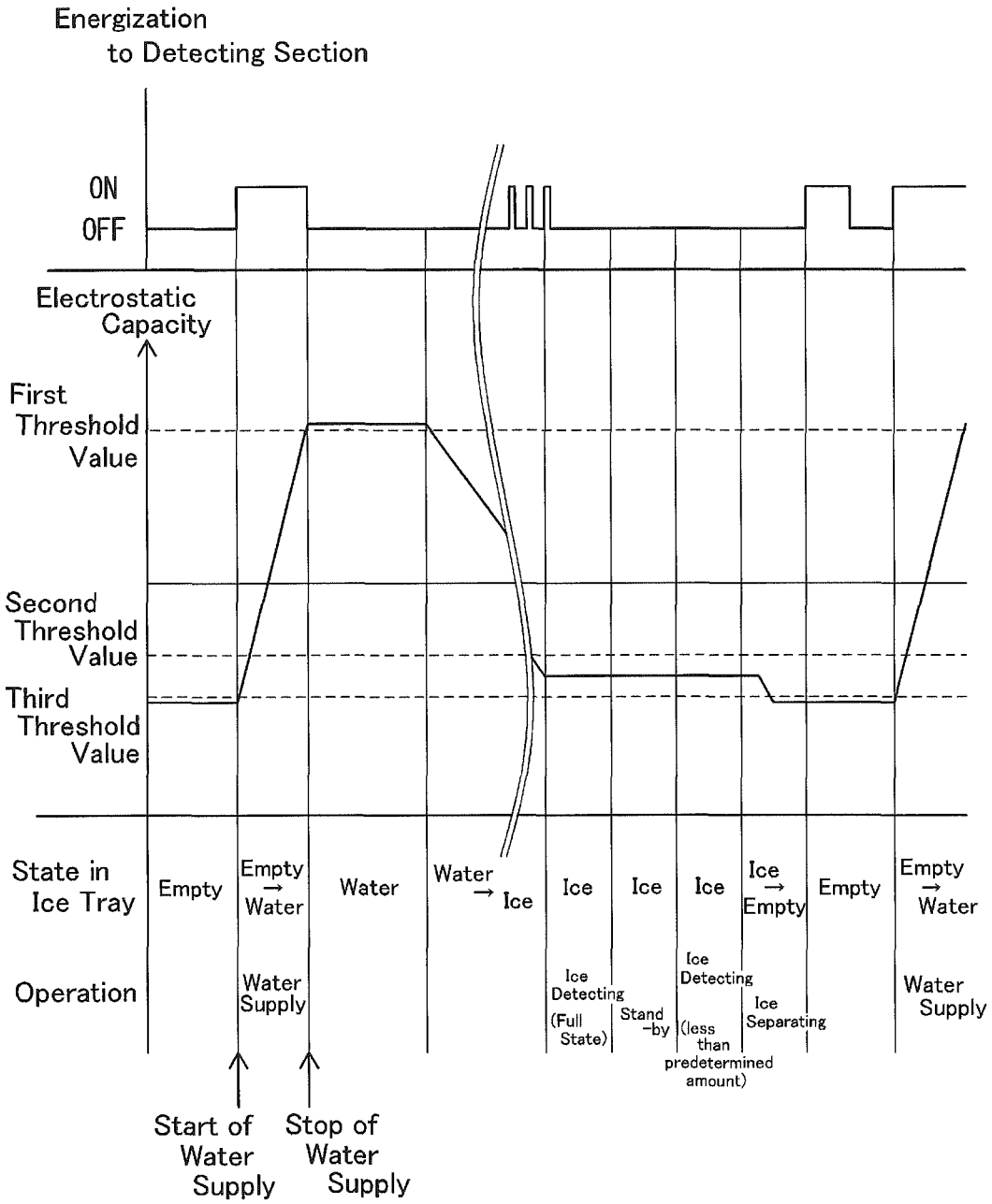
FIG. 4 is a time chart for explaining an operation of an ice making device.

When both of the first control example and the second control example are adopted, the control unit supplies an electric current to the detecting section (the water quantity detecting section, the ice frozen detecting section and the ice dropped detecting section) only in the cases as shown by the following (a) through (c) (see FIG. 4).

(a): When it is detected that the measured electrostatic capacity value becomes not less than the first threshold value (during a time period when water is supplied to the ice tray 10 by the water-supply part 20).

(b): When it is detected that the measured electrostatic capacity value becomes below the second threshold value from the above-mentioned certain time period has passed.

(c): In the case that the second operational example is adopted, after the ice separating operation is finished, when it is detected whether the measured electrostatic capacity value becomes below the third threshold value or not.

A third control example is a control method in which, in the third process, when it is detected whether the measured electrostatic capacity value becomes below the second threshold value or not (in the case described in the above-mentioned (b)), the control unit intermittently performs energization to the detecting section (ice frozen detecting section) for detecting the electrostatic capacity by the electrostatic capacity sensor 60. Delay of timing for detecting whether the measured electrostatic capacity value becomes below the second threshold value or not, in other words, delay of timing for detecting whether the water in the ice tray 10 has been frozen or not does not raise any problem (exact moment when water becomes ice pieces completely is not necessary). Therefore, when the detecting section is operated intermittently, for example, when the electrostatic capacity is detected with a fixed time interval, similarly to the first control example and the second control example, electric power required for detection of the electrostatic capacity is reduced.

Next, a structure of the electrostatic capacity sensor 60 will be described below. First, attaching positions of the electrodes 61 of the electrostatic capacity sensor 60 will be described below.

Attaching Position of Electrode

An example of attaching position shown in FIG. 3 shows a structure in which the electrodes 61 are attached along two faces oppositely disposed in the longitudinal direction of the ice tray 10. Specifically, FIG. 3 shows a structure that the electrodes 61 are attached to outer faces of two faces along the longitudinal direction in the wall part 12 of the ice tray 10. In the ice making device 1 in accordance with this embodiment, a connection part for connecting the ice tray 10 with other members (frame body of the device and the output shaft 33) is formed along the short side direction of the wall part 12 (nothing is provided along the longitudinal direction of the wall part 12) and thus the electrodes 61 can be attached to a wide face along the longitudinal direction. In other words, a size of the electrode 61 in a plane direction (area of the face of the electrode 61 which is oppositely disposed to the water) can be set in a size (area) substantially the same as the size of the wall part 12 in the longitudinal direction. Further, a distance between the electrodes 61 is substantially the same as a length in the short side direction of the ice tray 10. Therefore, according to this structure, the size of the electrode 61 can be increased and a distance between the electrodes 61 can be shortened, the electrostatic capacity sensor 60 with a high degree of detection accuracy is obtained. The ice making device 1 in accordance with this embodiment is a so-called "twist type" ice making device 1 and thus the ice tray 10 is twisted and deformed at the time of the ice separating operation. Therefore, when this structure is adopted, in order to prevent that the electrode 61 is largely deformed together with the twisted deformation of the ice tray 10 and, as a result, the electrode 61 is damaged, it is preferable that the electrode 61 is provided with a damage prevention mechanism described below.

Figure 7:
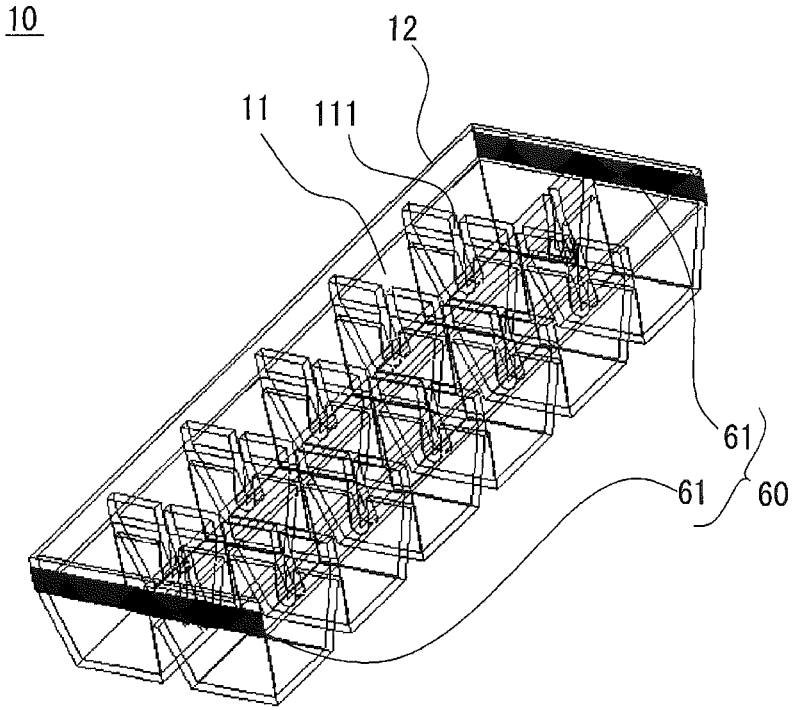
FIG. 7 is a view schematically showing an ice tray (a shaft-shaped part and a protruded part are not shown) in which electrodes of an electrostatic capacity sensor are attached along two faces in a short side direction of the ice tray oppositely disposed to each other.

Further, in a case of a so-called "scrape type" ice making device 1 in which ice pieces in the ice tray 10 are scraped out by a scrape member (see, for example, US 2010/0037633), connection parts for connecting the ice tray 10 with other members may be formed on faces along the longitudinal direction of the ice tray 10. When a structure is formed which obstructs the electrodes 61 to be attached to the faces along the longitudinal direction of the ice tray 10, the electrodes 61 may be attached to the faces along the short side direction (wall part 12 in the short side direction) (see FIG. 7).

Examples of an attaching position shown in FIG. 8 through FIG. 13 show a structure in which the electrodes 61 are attached to a unit of a cell 11 of the ice tray 10. According to these structures, in comparison with the structures shown in FIG. 3 and FIG. 7, a deformed quantity of the electrode 61 is small when the ice tray 10 is twisted and deformed at the time of the ice separating operation. Each of the examples is specifically described below.

Figure 8:
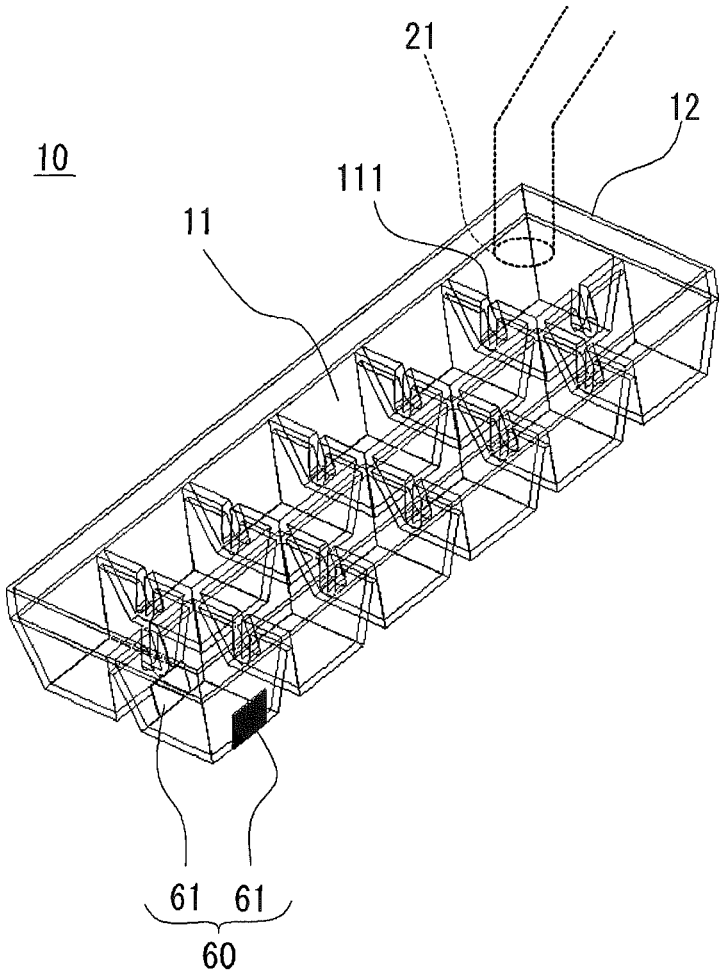
FIG. 8 is a view schematically showing an ice tray (a shaft-shaped part and a protruded part are not shown) in which electrodes of an electrostatic capacity sensor are attached to outer faces of a portion structuring one cell at positions facing each other.
Figure 9:
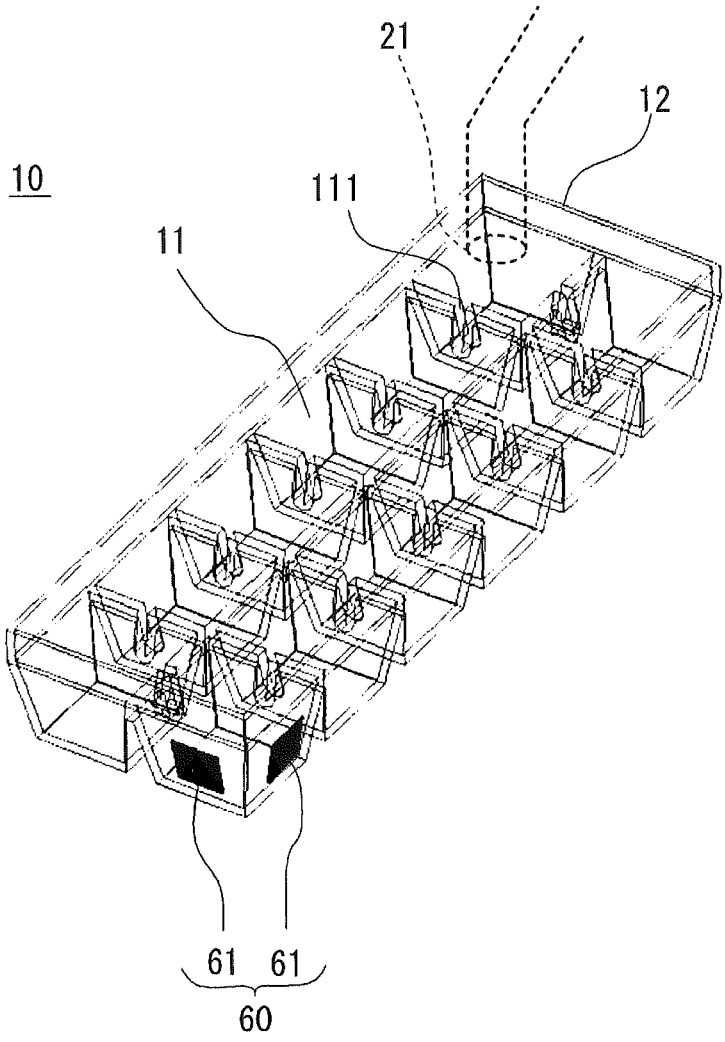
FIG. 9 is a view schematically showing an ice tray (a shaft-shaped part and a protruded part are not shown) in which electrodes of an electrostatic capacity sensor are attached to outer faces at positions perpendicular to each other of a portion structuring one cell.
Figure 10:
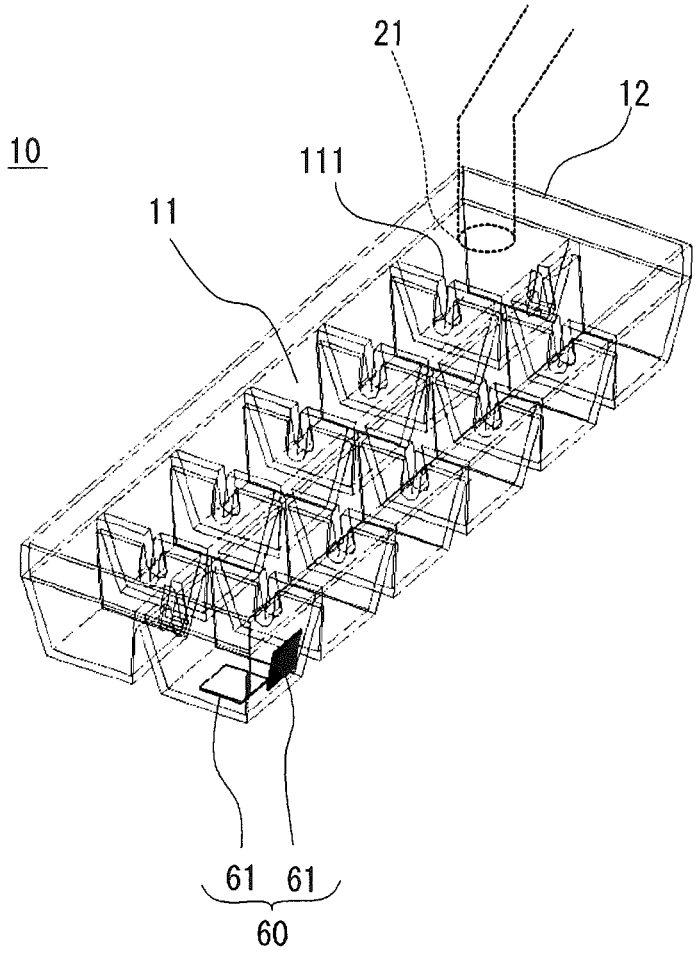
FIG. 10 is a view schematically showing an ice tray (a shaft-shaped part and a protruded part are not shown) in which electrodes of an electrostatic capacity sensor are attached to outer faces at positions perpendicular to each other of a portion structuring one cell (another example different from the example shown in FIG. 9).

FIGS. 8 through 10 show structures in which the electrodes 61 are attached to outer faces of a portion structuring one cell 11 of the ice tray 10. In other words, the electrodes 61 are attached so as to interpose one cell 11.

Specifically, FIG. 8 shows a structure in which the electrodes 61 are oppositely disposed to each other on outer faces of a portion structuring one cell 11 of the ice tray 10 (strictly, the electrodes 61 are inclined by an inclination of the cell 11). According to this structure, a distance between the electrodes 61 is small and thus detection accuracy of the electrostatic capacity sensor 60 is superior.

Further, in the structures shown in FIG. 9 and FIG. 10, the electrodes 61 are disposed on outer faces of a portion structuring one cell 11 of the ice tray 10 in a perpendicular state (strictly, the electrodes 61 are inclined by an inclination of the cell 11). According to this structure, both of the electrodes 61 are located on outer sides of the ice tray 10 and thus electric wiring can be easily performed.

In a case that the structures shown in FIGS. 8 through 10 are adopted, it is preferable that the one cell 11 to which the electrodes 61 are attached is located at the remotest position from the one or plural cells 11 which are located at the nearest position to the water-supply port 21 of the water-supply part 20. In other words, it is preferable that the one cell 11 to which the electrodes 61 are attached is the cell 11 into which water is finally flowed (which means that a predetermined quantity of water is stored) when water is supplied to the ice tray 10. When it is detected by the electrostatic capacity sensor 60 that a predetermined quantity of water is existed in the cell 11 into which water is finally flowed (when the measured electrostatic capacity value becomes not less than the first threshold value), a predetermined quantity of water is existed in other cells 11. In other words, a water-supply quantity to the ice tray 10 can be controlled accurately by controlling the water-supply quantity through the variation of the electrostatic capacity of the cell 11 into which water is flowed finally.

Figure 11:
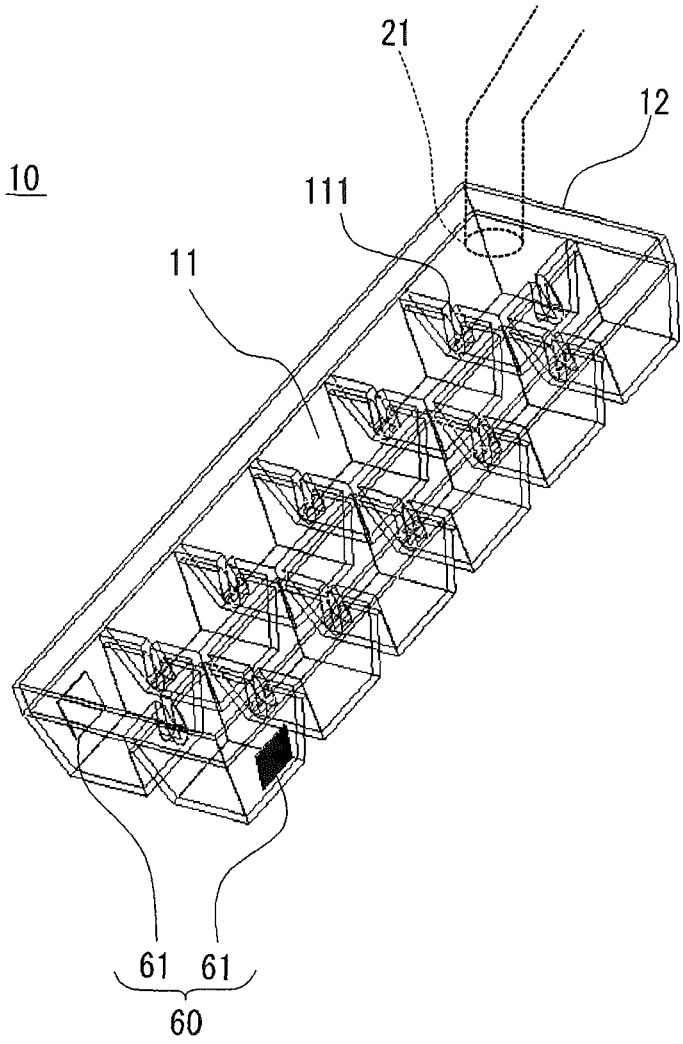
FIG. 11 is a view schematically showing an ice tray (a shaft-shaped part and a protruded part are not shown) in which electrodes of an electrostatic capacity sensor are attached to outer faces of two cells arranged in a short side direction of the ice tray.
Figure 12:
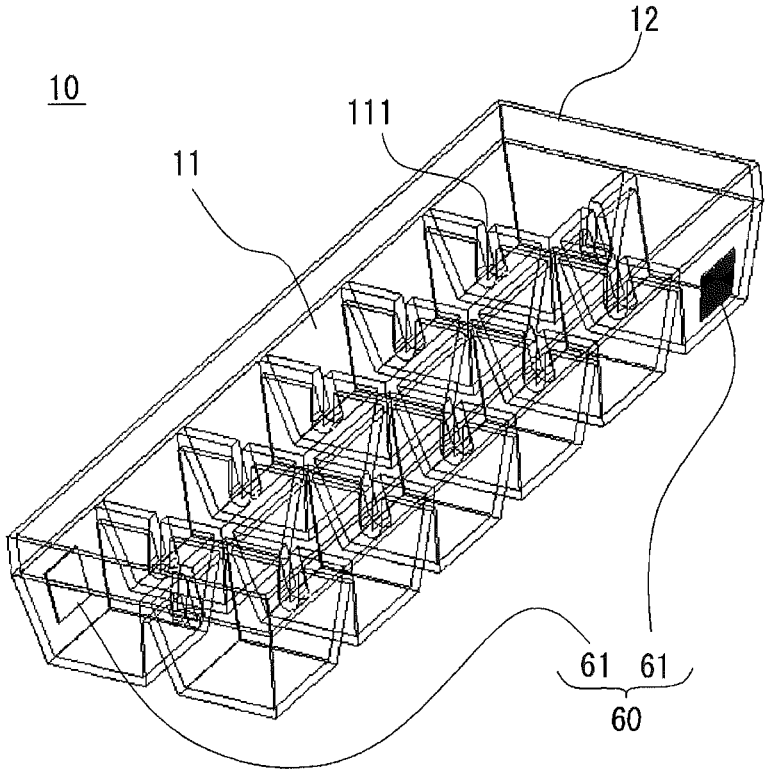
FIG. 12 is a view schematically showing an ice tray (a shaft-shaped part and a protruded part are not shown) in which one electrode of an electrostatic capacity sensor is attached to an outer face structuring a cell, which is located at one end in a longitudinal direction of the ice tray and at one end in its short side direction, and the other electrode of the electrostatic capacity sensor is attached to an outer face structuring a cell, which is located at the other end in the longitudinal direction of the ice tray and at the other end in its short side direction, and the electrodes are faced each other in the short side direction.
Figure 13:
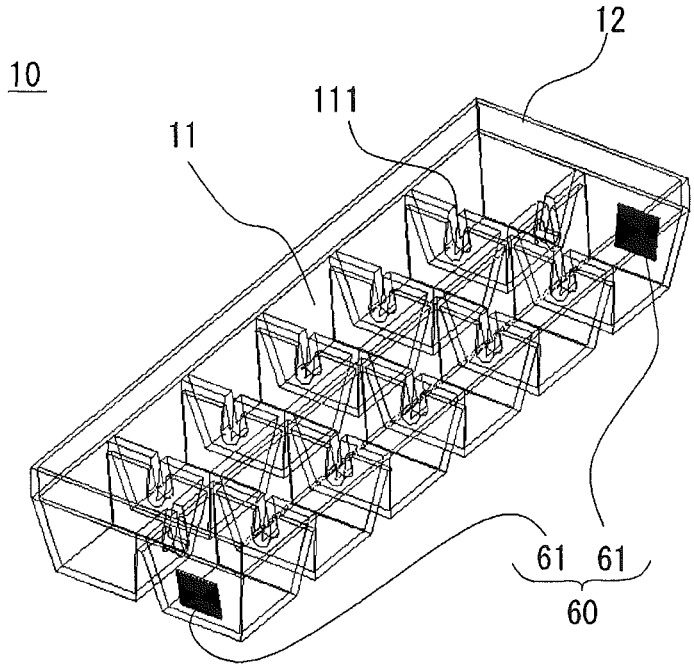
FIG. 13 is a view schematically showing an ice tray (a shaft-shaped part and a protruded part are not shown) in which electrodes of an electrostatic capacity sensor are attached to respective outer faces of two outermost cells of a plurality of cells arranged in a longitudinal direction of the ice tray.

In the structures shown in FIGS. 11 through 13, one electrode 61 is attached to an outer face structuring a certain cell 11 and the other electrode 61 is attached to an outer face structuring another cell 11 which is different from the certain cell 11. In other words, the electrodes 61 are attached so as to interpose a plurality of cells 11.

Specifically, in the structure shown in FIG. 11, the electrodes 61 are attached to respective outer faces of two cells 11 which are juxtaposed in the short side direction of the ice tray 10. In other words, both of the electrodes 61 are oppositely disposed to each other in the short side direction of the ice tray 10 (strictly, the electrodes 61 are inclined by an inclination of the cell 11). According to this structure, a distance between the electrodes 61 is relatively small and thus detection accuracy of the electrostatic capacity sensor 60 is superior. Further, both of the electrodes 61 are located on outer sides of the ice tray 10 and thus electric wiring can be easily performed. In accordance with an embodiment of the present invention, although a distance between the electrodes 61 becomes larger and thus the detection accuracy may be lower than the structure shown in FIG. 11, a structure as shown in FIG. 12 may be adopted. In other words, even when one electrode 61 is attached to an outer face (outer face along the longitudinal direction) which structures a cell 11 located at one end in the longitudinal direction and at one end in the short side direction of the ice tray 10 and the other electrode 61 is attached to an outer face (outer face along the longitudinal direction) which structures a cell 11 located at the other end in the longitudinal direction and at the other end in the short side direction of the ice tray 10 and the electrodes 61 are oppositely disposed to each other in the short side direction, variation of the electrostatic capacity within the ice tray 10 can be detected.

In a case that a structure is adopted in which the electrodes 61 are attached to respective outer faces of two cells 11 juxtaposed in the short side direction of the ice tray 10 as shown in FIG. 11, it is preferable that one of the cells 11 or both of the cells 11 are located at the remotest position from the one or plural cells 11 to which water is firstly supplied through the water-supply port 21 of the water-supply part 20. As described above, a water-supply quantity to the ice tray 10 can be controlled accurately by controlling the water-supply quantity through the variation of the electrostatic capacity of the cell 11 into which water is flowed and supplied finally. As described above, even in the structure that the electrodes 61 are attached so as to interpose a plurality of the cells 11, it is preferable that the electrodes 61 are attached to one or a plurality of the cells 11 located at the remotest position from the water-supply port 21 of the water-supply part 20.

Figure 14:
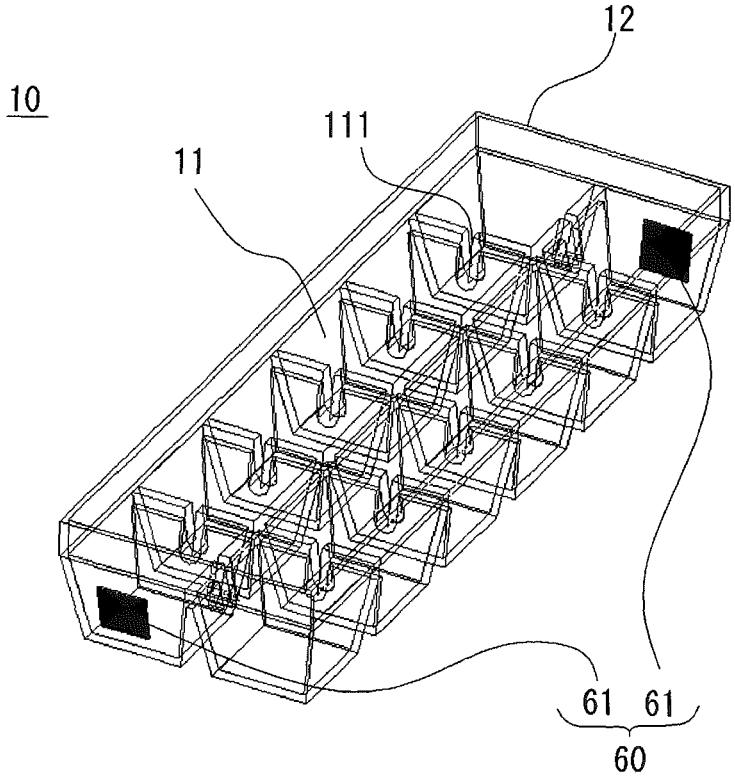
FIG. 14 is a view schematically showing an ice tray (a shaft-shaped part and a protruded part are not shown) in which one electrode of an electrostatic capacity sensor is attached to an outer face structuring a cell, which is located at one end in a longitudinal direction of the ice tray and at one end in its short side direction, and the other electrode of the electrostatic capacity sensor is attached to an outer face structuring a cell, which is located at the other end in the longitudinal direction of the ice tray and at the other end in its short side direction, and the electrodes are faced each other in the longitudinal direction.

Further, in the structure shown in FIG. 13, electrodes 61 are attached to respective outer faces of two cells 11 which are located on the outermost sides of a plurality of cells 11 juxtaposed in the longitudinal direction of the ice tray 10. According to this structure, both of the electrodes 61 are located on outer sides of the ice tray 10 and thus electric wiring can be easily performed. In accordance with an embodiment of the present invention, although a distance between the electrodes 61 becomes larger and thus the detection accuracy may be lower than the structure shown in FIG. 13, a structure as shown in FIG. 14 may be adopted. In other words, even when one electrode 61 is attached to an outer face (outer face along the short side direction) which structures a cell 11 located at one end in the longitudinal direction and at one end in the short side direction of the ice tray 10 and the other electrode 61 is attached to an outer face (outer face along the short side direction) which structures a cell 11 located at the other end in the longitudinal direction and at the other end in the short side direction of the ice tray 10 and the electrodes 61 are oppositely disposed to each other in the longitudinal direction, variation of the electrostatic capacity within the ice tray 10 can be detected.

In all the attaching positions of the electrodes 61 as described above, the electrodes 61 are attached to outer faces of the ice tray 10 made of resin which is an insulator (the structure includes all the structures except that the electrodes 61 are attached so as to be exposed on an inner space of the ice tray 10). Therefore, the electrode 61 is separated from water which is supplied to the ice tray 10 and thus corrosion of the electrode 61 by water is prevented.

Damage Prevention Mechanism for Electrode

In a so-called "twist type" ice making device 1 like this embodiment, the ice tray 10 is twisted and deformed (elastically deformed) when the ice separating operation is performed. Therefore, it is preferable that a structure to which a damage prevention mechanism for the electrode 61 is applied is provided as described below so that the electrode 61 structuring the electrostatic capacity sensor 60 is not damaged due to its large deformation together with the twisted deformation of the ice tray 10.

Figure 15:
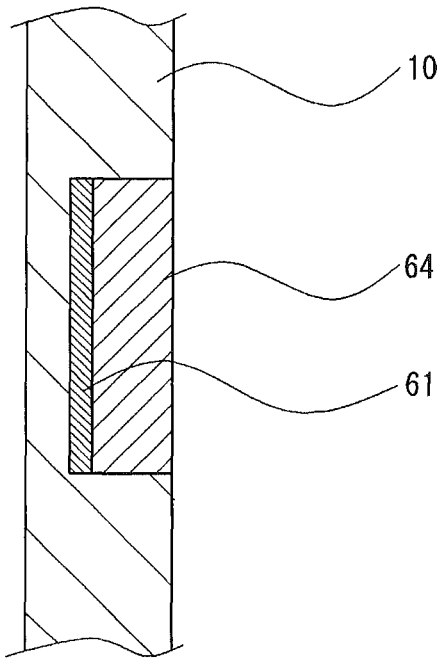
FIG. 15 is an explanatory view showing a structure in which an electrode of an electrostatic capacity sensor is attached to an ice tray through a displacement absorption member (an enlarged cross-sectional view showing a portion where an electrode is attached).

A first mechanism shown in FIG. 15 is a mechanism in which the electrode 61 structuring the electrostatic capacity sensor 60 is attached to the ice tray 10 through a displacement absorption member 64. Specifically, the electrode 61 is attached to the ice tray 10 through the displacement absorption member 64 in a tightly contacted state with the ice tray 10 but in a state that the electrode 61 is not joined to the ice tray 10. The displacement absorption member 64 is a structural member for holding the electrode 61 which is not joined to the ice tray 10. In this structure, even when the ice tray 10 is deformed, the electrode 61 which is not joined to the ice tray 10 is not deformed largely. In other words, even when the ice tray 10 is deformed, the displacement absorption member 64 which can be deformed easier (softer) than the ice tray 10 is disposed on an outer side of the electrode 61. Therefore, the electrode 61 pushes the displacement absorption member 64 aside so as to maintain its state (natural state) as it is and the electrode 61 is not deformed largely.

Accordingly, when the structure described above is adopted, damage of the electrode 61 due to its large deformation can be prevented. Further, the electrode 61 hardly affects easy deformability of the entire ice tray 10 including the electrode 61 and thus a thickness and material of the electrode 61 can be selected freely and a torque of the motor 31 for deforming the ice tray 10 can be made small. It is preferable that the displacement absorption member 64 is formed of material which is easy to be deformed as much as possible in a range that the electrode 61 is not detached from the ice tray 10. Specifically, for example, silicon resin is utilized as the displacement absorption member 64. Further, in the structure described above, the electrode 61 and the ice tray 10 are tightly contacted with each other (nothing is existed between the electrode 61 and the ice tray 10) and thus detection accuracy of the electrostatic capacity sensor 60 is superior.

A second mechanism is a structure in which the electrode 61 itself structuring the electrostatic capacity sensor 60 is structured to be easily deformed. Specifically, the electrode 61 attached to the ice tray 10 is capable of being restored to its original state by a restoring force of the ice tray 10 which has been twisted and deformed at the time of the ice separating operation. For example, the electrode 61 may be formed in a sheet-like shape which is formed of aluminum foil or copper foil, may be formed of elastic material having an electrically conductive property by kneading conductive carbon powder or metal powder, material which is formed by disposing wire-shaped conductors in a mesh-like shape, material which is formed of cotton-shaped conductor in which fibrous conductors are randomly arranged and which is cut off in a predetermined size, or the like. When these materials are cut off in a predetermined size and used as the electrode 61, variation of the electrostatic capacity can be detected.

When the structure as described above is adopted, damage of the electrode 61 due to the deformation of the ice tray 10 can be prevented. Further, the rigidity of the electrode 61 hardly affects easy deformability of the entire ice tray 10 including the electrode 61 and thus a torque of the motor 31 for deforming the ice tray 10 can be made small. In this structure, the electrode 61 may be attached to the ice tray 10 in any method. For example, a mounting method by adhesion (by using an adhesive or a double-side tape) or a mounting method by using a fixing member such as a screw may be utilized.

In a third mechanism, an ice making device 1 is further provided with an electrode drive part for moving the electrodes 61 of the electrostatic capacity sensor 60. The electrode drive part is capable of moving the electrodes 61 from a first position shown in FIG. 16(*a*) to a second position shown in FIGS. 16(*b*) and 16(*c*) and is controlled by a control unit as follows.

Figure 16A:
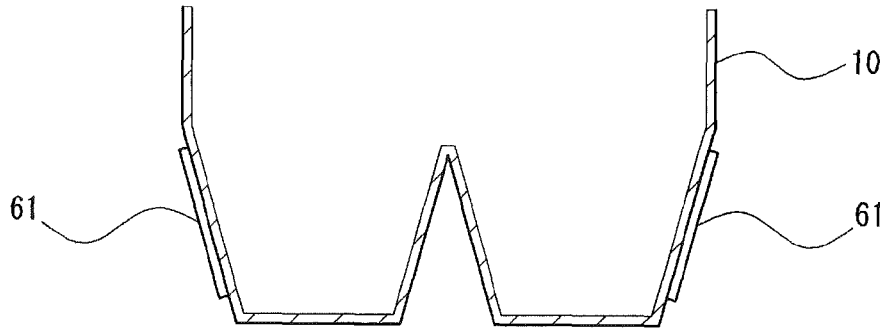
FIGS. 16(*a*), 16(*b*) and 16(*c*) are schematic views for explaining a function of an electrode drive part for moving electrodes of an electrostatic capacity sensor.
Figure 16B:
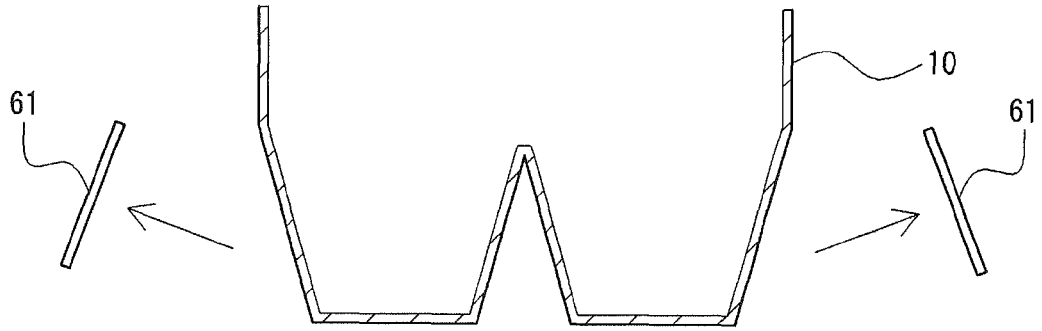
Figure 16C:
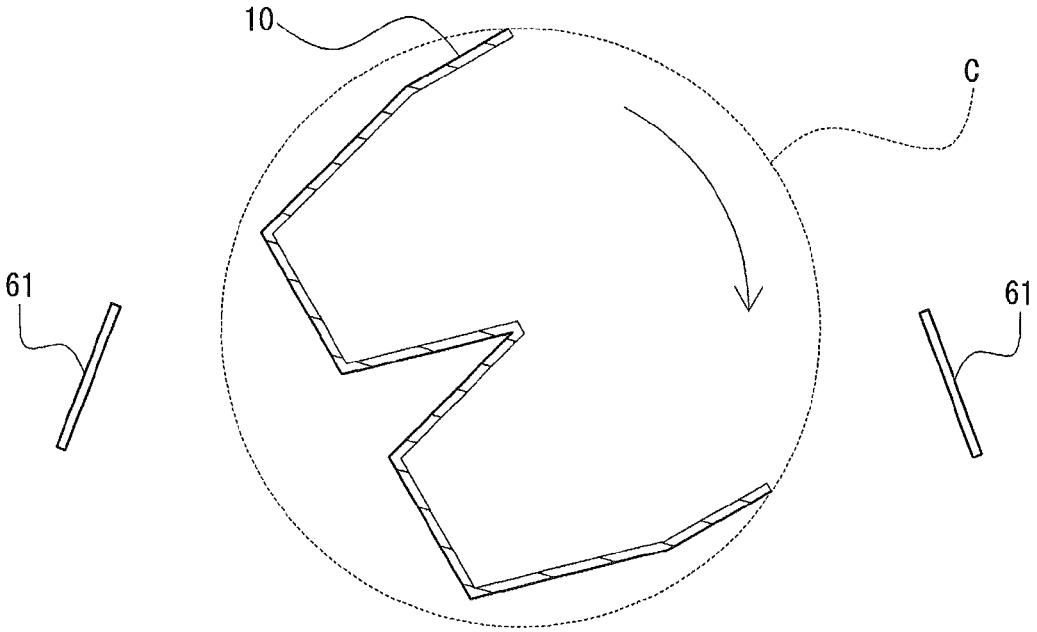

When water is being supplied to the ice tray 10 by the water-supply part 20 (from the start of supplying water to the ice tray 10 to the time when the measured electrostatic capacity value becomes not less than the first threshold value and the water supply is stopped), and when the water in the ice tray 10 is not frozen yet (from the time when water supply is stopped to the time that the measured electrostatic capacity value becomes below the second threshold value), the electrode drive part is set in a state that the electrodes 61 are abutted with the ice tray 10, in other words, in a state that the electrodes 61 are located at the first position shown in FIG. 16(*a*). On the other hand, after the water in the ice tray 10 has been frozen, when the ice tray 10 is being turned by the ice tray drive part (immediately before the ice tray 10 is to be turned), the electrode drive part moves the electrodes 61 to a position where the electrodes 61 are not located at the turning locus "C" of the ice tray 10 (see FIG. 16(*c*)). In other words, the electrode drive part sets the electrodes 61 in the state that the electrodes 61 are located at the second position as shown in FIGS. 16(*b*) and 16(*c*). When the ice separating operation has been finished and the ice tray 10 is returned to the home position, the electrode drive part moves the electrodes 61 to the state that the electrodes 61 are abutted with the ice tray 10 again. In other words, the electrode drive part sets the electrodes 61 to the state that the electrodes 61 are located at the first position shown in FIG. 16(*a*).

According to this structure, the electrodes 61 are separated from the ice tray 10 while the ice tray 10 is elastically deformed and thus damage of the electrodes 61 caused by large deformation is prevented. Further, the electrode 61 hardly affects easy deformability of the entire ice tray 10 including the electrode 61 and thus a thickness and material of the electrode 61 can be selected freely and a torque of the motor 31 for deforming the ice tray 10 can be made small. In addition, since the electrode 61 is not attached to the ice tray 10 directly or indirectly, only the ice tray 10 is capable of being detached for washing without detaching electric wiring which connects the electrode 61 with the detecting section.

Figure 17A:
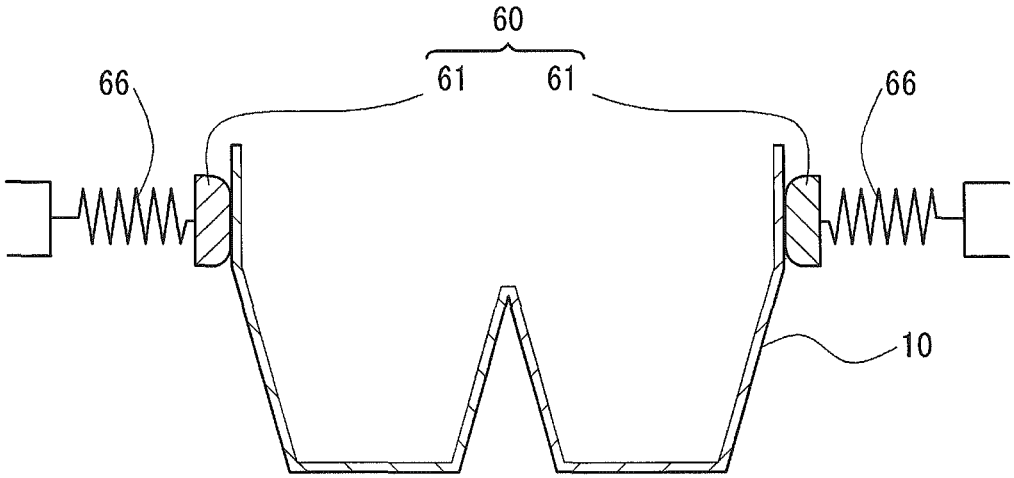
FIGS. 17(*a*) and 17(*b*) are cross-sectional views showing an example in which electrodes of an electrostatic capacity sensor are attached in a pressed state against outer faces of an ice tray by urging members.
Figure 17B:
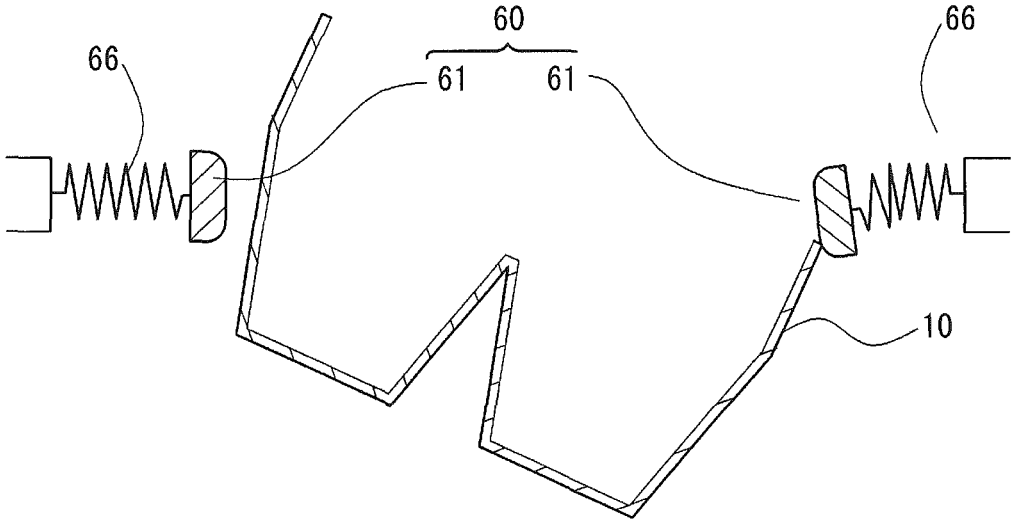

In a fourth mechanism, as shown in FIG. 17(*a*), the electrodes 61 of the electrostatic capacity sensor 60 is pressed against the outer face of the ice tray 10 by an urging member 66 (spring or the like) which is connected with an outer side of the electrode 61. The position of the electrode 61 when the urging member 66 is in a natural length (position of the electrode 61 in a state that the electrode 61 is not contacted with the ice tray 10) is located on a slightly inner side with respect to the state that the electrode 61 is pressed against the outer face of the ice tray 10 and a tip end side (ice tray 10 side) of the electrode 61 is chamfered. Specifically, a size of the chamfered corner (thickness of chamfered portion) in a thickness direction of the electrode 61 is set to be larger than a difference between the position of the electrode 61 when pressed against the outer face of the ice tray 10 and the position of the electrode 61 when the urging member 66 is in a natural length.

When the ice separating operation is to be performed, the ice tray 10 is turned so as to push the electrodes 61 aside while the urging members 66 are elastically deformed. The tip end side of the electrode 61 is formed with the chamfered portion as described above and thus the ice tray 10 is not caught by the electrode 61 when the ice tray 10 is to be returned to the home position. In other words, as shown in FIG. 17(*b*), the chamfered portion of the electrode 61 slides on the outer face of the ice tray 10 and the electrode 61 is returned to the state that the electrode 61 is pressed against the outer face of the ice tray 10 (state shown in FIG. 17(*a*)).

According to this structure, the electrode 61 is prevented from being deformed with elastic deformation of the ice tray 10. In other words, the urging member 66 is deformed but the electrode 61 is not deformed by turning of the ice tray 10 and thus damage of the electrode 61 due to deformation is prevented. Further, the electrode 61 hardly affects easy deformability of the entire ice tray 10 including the electrode 61 and thus a thickness and material of the electrode 61 can be selected freely and a torque of the motor 31 for deforming the ice tray 10 can be made small. In addition, a drive source for driving the electrode 61 like the third mechanism is not required.

The damage prevention mechanism for the electrode 61 described above may be applied to a case where the electrode 61 is attached to any position. Especially, in the case that the electrodes 61 are attached along two faces oppositely disposed to each other along the longitudinal direction of the wall part 12 of the ice tray 10 shown in FIG. 3, the electrodes 61 may be deformed largely together with elastic deformation of the ice tray 10 and thus the damage prevention mechanism for the electrode described above is remarkably effective.

On the other hand, in a case of a so-called "scrape type" ice making device 1, the ice tray 10 is not elastically deformed and thus the damage prevention mechanism for the electrode 61 is unnecessary. In other words, an electrode 61 having an arbitrary shape and thickness may be directly fixed at an arbitrary position of the ice tray 10.

Although the present invention has been shown and described with reference to a specific embodiment, various changes and modifications will be apparent to those skilled in the art from the teachings herein.

While the description above refers to particular embodiments of the present invention, it will be understood that many modifications may be made without departing from the spirit thereof. The accompanying claims are intended to cover such modifications as would fall within the true scope and spirit of the present invention.

The presently disclosed embodiments are therefore to be considered in all respects as illustrative and not restrictive, the scope of the invention being indicated by the appended claims, rather than the foregoing description, and all changes which come within the meaning and range of equivalency of the claims are therefore intended to be embraced therein.

What is claimed is:

1. An ice making device comprising:

an ice tray;

a water-supply part configured to supply water to the ice tray;

an ice tray drive part configured to perform an ice separating operation on the ice tray;

an ice storage container in which ice pieces dropped from the ice tray are stored;

an ice detecting part for detecting whether an ice quantity in the ice storage container is less than a certain amount or not;

an electrostatic capacity sensor having two or more electrodes which are attached to the ice tray and are respectively insulated; and a control unit configured to control the water-supply part, the ice tray drive part and the ice detecting part on a basis of variation of an electrostatic capacity between the electrodes of the electrostatic capacity sensor so as to perform:

confirming that the ice tray is located at a home position and water supply to the ice tray is started through the water-supply part;

continuing the water supply through the water-supply part until a measured electrostatic capacity value becomes not less than a first threshold value and, in response to the measured electrostatic capacity value becoming not less than the first threshold value, stopping the water supply through the water-supply part;

after the water supply is stopped, in response to the measured electrostatic capacity value becoming below a second threshold value and it is detected by the ice detecting part that a quantity of ice pieces in the ice storage container is less than a certain amount, performing an ice separating operation by the ice tray drive part;

after the ice separating operation is finished, returning the ice tray the home position by the ice tray drive part and an operation of the first process is started;

wherein the first threshold value is a value which is predetermined on a basis of an electrostatic capacity value in a state that a predetermined quantity of water is existed in the ice tray, and the second threshold value is a value which is predetermined on the basis of the electrostatic capacity value in a state that all the predetermined quantity of the water in the ice tray has been frozen; and in an initial state, the control unit controls so that:

when the measured electrostatic capacity value is not less than the second threshold value, the ice separating operation is performed, and when the measured electrostatic capacity value is below the second threshold value and the ice detecting part detects that the quantity of the ice pieces in the ice storage container is less than the certain amount, the ice separating operation is performed by the ice tray drive part and then the ice tray is returned to the home position.

2. The ice making device according to claim 1, wherein the control unit stops energization to a detecting section for detecting the electrostatic capacity between the electrodes of the electrostatic capacity sensor until a predetermined time period is passed after the water supply is stopped.

3. The ice making device according to claim 1, wherein the control unit is configured to stop energization to a detecting section for detecting the electrostatic capacity between the electrodes of the electrostatic capacity sensor until the ice separating operation is finished after the measured electrostatic capacity value becomes below the second threshold value.

4. The ice making device according to claim 1, wherein the control unit is configured to intermittently perform energization to a detecting section for detecting the electrostatic capacity between the electrodes of the electrostatic capacity sensor when it is detected whether the measured electrostatic capacity value becomes below the second threshold value or not.

5. An ice making device comprising:

an ice tray;

a water-supply part configured to supply water to the ice tray;

an ice tray drive part configured to perform an ice separating operation on the ice tray;

an ice storage container in which ice pieces dropped from the ice tray are stored;

an ice detecting part configured to detect whether an ice quantity in the ice storage container is less than a certain amount or not;

an electrostatic capacity sensor having two or more electrodes which are attached to the ice tray and are respectively insulated; and a control unit configured to control the water-supply part, the ice tray drive part and the ice detecting part on a basis of variation of an electrostatic capacity between the electrodes of the electrostatic capacity sensor so as to perform:

confirming that the ice tray is located at a home position and water supply to the ice tray is started through the water-supply part;

continuing the water supply through the water-supply part until a measured electrostatic capacity value becomes not less than a first threshold value and, in response to the measured electrostatic capacity value becoming not less than the first threshold value, stopping the water supply through the water-supply part;

after the water supply is stopped, in response to the measured electrostatic capacity value becoming below a second threshold value and it is detected by the ice detecting part that a quantity of ice pieces in the ice storage container is less than a certain amount, performing an ice separating operation by the ice tray drive part;

after the ice separating operation is finished, returning the ice tray to the home position by the ice tray drive part, unless the measured electrostatic capacity value is not less than a third threshold value, in which case the ice separating operation is performed by the ice tray drive part again, and the ice tray is returned to the home position by the ice tray drive part again;

wherein the first threshold value is a value which is predetermined on a basis of an electrostatic capacity value in a state that a predetermined quantity of water is existed in the ice tray, the second threshold value is a value which is predetermined on the basis of the electrostatic capacity value in a state that all the predetermined quantity of the water in the ice tray has been frozen, and the third threshold value is a value which is predetermined on the basis of the electrostatic capacity value in a state that the ice tray is empty; and in an initial state, the control unit controls so that:

in a case that the measured electrostatic capacity value is not less than the second threshold value, the ice separating operation is performed, in a case that the measured electrostatic capacity value is below the second threshold value and not less than the third threshold value, and the ice detecting part detects that a quantity of ice pieces in the ice storage container is less than a certain amount, an ice separating operation is performed by the ice tray drive part and then the ice tray is returned to the home position, and in a case that the measured electrostatic capacity value is below the third threshold value, the ice tray is confirmed to be located at a home position and water supply to the ice tray is started through the water-supply part.

6. The ice making device according to claim 5, wherein the control unit is configured to stop energization to a detecting section for detecting the electrostatic capacity between the electrodes of the electrostatic capacity sensor until a predetermined time period is passed after the water supply is stopped.

7. The ice making device according to claim 5, wherein the control unit is configured to stop energization to a detecting section for detecting the electrostatic capacity between the electrodes of the electrostatic capacity sensor until the ice separating operation is finished after the measured electrostatic capacity value becomes below the second threshold value.

8. The ice making device according to claim 5, wherein the control unit is configured to intermittently perform energization to a detecting section for detecting the electrostatic capacity between the electrodes of the electrostatic capacity sensor when it is detected whether the measured electrostatic capacity value becomes below the second threshold value or not.

9. An ice making device comprising:

an ice tray which is formed of an insulator;

a water-supply part configured to supply water to the ice tray;

an electrostatic capacity sensor having two or more electrodes which are attached to the ice tray and are respectively insulated;

a water quantity detecting section configured to detect a water quantity in the ice tray which is supplied through the water-supply part on a basis of variation of an electrostatic capacity between the electrodes of the electrostatic capacity sensor;

an ice tray drive part configured to turn and elastically deform the ice tray to a state that an opening of the ice tray is directed downward after the water in the ice tray is detected to be frozen, and an electrode moving part configured to set in a state that the electrodes of the electrostatic capacity sensor are abutted with the ice tray when water is supplied to the ice tray through the water-supply part and when the water in the ice tray is not frozen yet and, after the water in the ice tray has been frozen and when the ice tray is turned by the ice tray drive part, the electrode moving part moving the electrodes of the electrostatic capacity sensor to a position where the electrodes of the electrostatic capacity sensor are not located at a turning locus of the ice tray;

wherein the electrodes of the electrostatic capacity sensor are attached to an outer face of the ice tray.

10. A control method for an ice making device including an ice tray, a water-supply part for supplying water to the ice tray, an ice tray drive part for performing an ice separating operation on the ice tray, an ice storage container in which ice pieces dropped from the ice tray are stored, an ice detecting part for detecting whether an ice quantity in the ice storage container is less than a certain amount or not, an electrostatic capacity sensor having two or more electrodes which are attached to the ice tray and are respectively insulated, and a control unit for the ice making device, the control method comprising:

confirming that the ice tray is located at a home position and water supply to the ice tray is started through the water-supply part;

continuing the water supply through the water-supply part until a measured electrostatic capacity value becomes not less than a first threshold value and, in response to the measured electrostatic capacity value becoming not less than the first threshold value, stopping the water supply through the water-supply part;

after the water supply is stopped, in response to the measured electrostatic capacity value becoming below a second threshold value and it is detected by the ice detecting part that a quantity of ice pieces in the ice storage container is less than a certain amount, performing an ice separating operation is performed by the ice tray drive part; and after the ice separating operation is finished, returning the ice tray to the home position by the ice tray drive;

wherein the first threshold value is a value which is predetermined on a basis of an electrostatic capacity value in a state that a predetermined quantity of water is existed in the ice tray, and the second threshold value is a value which is predetermined on the basis of the electrostatic capacity value in a state that all the predetermined quantity of the water in the ice tray has been frozen; and in an initial state when the measured electrostatic capacity value is not less than the second threshold value, the ice separating operation is performed, and when the measured electrostatic capacity value is below the second threshold value and the ice detecting part detects that the quantity of the ice pieces in the ice storage container is less than the certain amount, the ice separating operation is performed by the ice tray drive part and then the ice tray is returned to the home position.

11. The control method for an ice making device according to claim 10, wherein energization to a detecting section for detecting the electrostatic capacity between the electrodes of the electrostatic capacity sensor is stopped until a predetermined time period is passed after the water supply is stopped.

12. The control method for an ice making device according to claim 10, wherein energization to a detecting section for detecting the electrostatic capacity between the electrodes of the electrostatic capacity sensor is stopped until the ice separating operation is finished after the measured electrostatic capacity value becomes below the second threshold value.

13. The control method for an ice making device according to claim 10, wherein energization to a detecting section for detecting the electrostatic capacity between the electrodes of the electrostatic capacity sensor is intermittently performed when it is detected whether the measured electrostatic capacity value becomes below the second threshold value or not.

14. A control method for an ice making device including an ice tray, a water-supply part for supplying water to the ice tray, an ice tray drive part for performing an ice separating operation on the ice tray, an ice storage container in which ice pieces dropped from the ice tray are stored, an ice detecting part for detecting whether an ice quantity in the ice storage container is less than a certain amount or not, an electrostatic capacity sensor having two or more electrodes which are attached to the ice tray and are respectively insulated, and a control unit for the ice making device, the control method comprising:

confirming that the ice tray is located at a home position and water supply to the ice tray is started through the water-supply part;

continuing the water supply through the water-supply part until a measured electrostatic capacity value becomes not less than a first threshold value and, in response to the measured electrostatic capacity value becoming not less than the first threshold value, stopping the water supply through the water-supply part;

after the water supply is stopped, in response to the measured electrostatic capacity value becoming below a second threshold value and it is detected by the ice detecting part that a quantity of ice pieces in the ice storage container is less than a certain amount, performing an ice separating operation by the ice tray drive part;

after the ice separating operation is finished, returning the ice tray to the home position by the ice tray drive part, unless the measured electrostatic capacity value is not less than a third threshold value, in which case the ice separating operation is performed by the ice tray drive part again;

wherein the first threshold value is a value which is predetermined on a basis of an electrostatic capacity value in a state that a predetermined quantity of water is existed in the ice tray, the second threshold value is a value which is predetermined on the basis of the electrostatic capacity value in a state that all the predetermined quantity of the water in the ice tray has been frozen, and the third threshold value is a value which is predetermined on the basis of the electrostatic capacity value in a state that the ice tray is empty; and in an initial state, in a case that the measured electrostatic capacity value is not less than the second threshold value, the ice separating operation is performed, in a case that the measured electrostatic capacity value is below the second threshold value and not less than the third threshold value, and the ice detecting part detects that a quantity of ice pieces in the ice storage container is less than a certain amount, an ice separating operation is performed by the ice tray drive part and then the ice tray is returned to the home position, and in a case that the measured electrostatic capacity value is below the third threshold value, the ice tray is confirmed to be located at a home position and water supply to the ice tray is started through the water-supply part.

15. The control method for an ice making device according to claim 14, wherein energization to a detecting section for detecting the electrostatic capacity between the electrodes of the electrostatic capacity sensor is stopped until a predetermined time period is passed after the water supply is stopped.

16. The control method for an ice making device according to claim 14, wherein energization to a detecting section for detecting the electrostatic capacity between the electrodes of the electrostatic capacity sensor is stopped until the ice separating operation is finished after the measured electrostatic capacity value becomes below the second threshold value.

17. The control method for an ice making device according to claim 14, wherein energization to a detecting section for detecting the electrostatic capacity between the electrodes of the electrostatic capacity sensor is intermittently performed when it is detected whether the measured electrostatic capacity value becomes below the second threshold value or not.

* * * * *